US006900704B2

(12) United States Patent
Hasegawa

(10) Patent No.: US 6,900,704 B2
(45) Date of Patent: May 31, 2005

(54) TWO-PORT ISOLATOR AND COMMUNICATION DEVICE

(75) Inventor: Takashi Hasegawa, Mattou (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 11 days.

(21) Appl. No.: 10/607,300

(22) Filed: Jun. 27, 2003

(65) Prior Publication Data

US 2004/0207479 A1 Oct. 21, 2004

(30) Foreign Application Priority Data

Jun. 27, 2002 (JP) ..... 2002-188516

(51) Int. Cl.[7] ..... H01P 1/36
(52) U.S. Cl. ..... 333/24.2; 333/1.1
(58) Field of Search ..... 333/24.2, 1.1

(56) References Cited

U.S. PATENT DOCUMENTS 3,010,085 A * 11/1961 Seidel ..... 333/24.2

FOREIGN PATENT DOCUMENTS

| | | | |
|---|---|---|---|
| JP | 9-232818 | | 9/1997 |
| JP | 2001-185912 | | 7/2001 |
| JP | 2001203507 A | * | 7/2001 |
| JP | 2001-237613 | | 8/2001 |

* cited by examiner

*Primary Examiner*—Stephen E. Jones
(74) *Attorney, Agent, or Firm*—Keating & Bennett, LLP

(57) ABSTRACT

A two-port isolator includes a metal case including an upper metal case and a lower metal case, a permanent magnet, a central electrode assembly made of a ferrite and central electrodes, and a laminated substrate. In the central electrode assembly, the first and second central electrodes are disposed on the top surface of the disk-shaped microwave ferrite such that the first and second central electrodes intersect each other at right angles with an insulating layer therebetween. The electrode width of the first central electrode is different from the electrode width of the second central electrode. Thus, the inductance of the first central electrode and the inductance of the second central electrode are different from each other.

27 Claims, 31 Drawing Sheets

TWO-PORT ISOLATOR AND COMMUNICATION DEVICE

BACKGROUND OF THE INVENTION

1. Field of the Invention

The present invention relates to a two-port isolator, and more particularly, to a two-port isolator preferably for use in microwave frequency bands, and to communication device.

2. Description of the Related Art

Generally, an isolator allows a signal to pass only in one transmission direction and stops a signal in the other transmission direction, and is used in the transmission circuits of mobile communication equipment, such as automobile telephones and portable telephones.

A two-port isolator (e.g., an isolator having two central electrodes) has been commonly used for such isolators. This two-port isolator includes a permanent magnet, a ferrite, a first central electrode and a second central electrode disposed on a main surface of the ferrite, two matching capacitors, and a resistor mounted in a metal case including a lower metal case and an upper metal case, which are joined together. Normally, the first central electrode and the second central electrode have the same shape and the two matching capacitors have the same capacitance.

The insertion loss and isolation characteristics of such a two-port isolator used in mobile communication equipment are set according to the communication system used. Accordingly, when the insertion loss and isolation characteristics of a typical two-port isolator are compared with the requirements of a communication system, even if the isolation characteristics satisfy the requirements, the insertion loss characteristics may not fully meet the requirements. On the contrary, even if the insertion loss characteristics satisfy the requirements, there are cases where the isolation characteristics do not fully meet the requirements.

On the other hand, in mobile communication equipment, there is a strong demand for reducing the insertion loss in order to suppress the power dissipation in the transmission circuit portion and increase continuous talk time, even if the isolation characteristics are deteriorated. However, the required insertion and isolation characteristics of two-port isolators have not previous been achieved.

SUMMARY OF THE INVENTION

To overcome the problems described above, preferred embodiments of the present invention provide a two-port isolator and communication device in which the insertion loss and isolation characteristics can be effectively adjusted.

A two-port isolator according to preferred embodiments of the present invention includes a permanent magnet, a ferrite to which a DC magnetic field is applied by the permanent magnet, a first central electrode which is disposed on a main surface of the ferrite or inside the ferrite, one end of which is electrically connected to a first input-output port, and the other end of which is electrically connected to a second input-output port, a second central electrode which is disposed on the main surface of the ferrite or inside the ferrite so as to intersect the first central electrode with electrical insulation therebetween, one end of which is electrically connected to the second input-output port, and the other end of which is electrically connected to a third port, a first matching capacitor electrically connected between the first input-output port and the second input-output port, a resistor electrically connected between the first input-output port and the second input-output port, and a second matching capacitor electrically connected between the second input-output port and the third port.

The third port is preferably electrically connected to a ground and the inductance L1 of the first central electrode is different from the inductance L2 of the second central electrode.

Furthermore, a two-port isolator according to another preferred embodiment of the present invention includes a permanent magnet, a ferrite to which a DC magnetic field is applied by the permanent magnet, a first central electrode which is disposed on a main surface of the ferrite or inside the ferrite, one end of which is electrically connected to a first input-output port, and the other end of which is electrically connected to a second input-output port, a second central electrode which is disposed on the main surface of the ferrite or inside the ferrite so as to intersect the first central electrode with electrical insulation therebetween, one end of which is electrically connected to the second input-output port, and the other end of which is electrically connected to a third port, a first matching capacitor electrically connected between the first input-output port and the second input-output port, a second matching capacitor electrically connected between the second input-output port and the third port, a resistor electrically connected between the third port and a ground.

In this two-port isolator, the inductance L1 of the first central electrode is preferably different from the inductance L2 of the second central electrode.

In order for the inductance L1 of the first central electrode to be different from the inductance L2 of the second central electrode, for example, the electrode width, the electrode thickness, the electrode length, the number of electrodes, and the spacing between electrodes, of both electrodes may be made different. Furthermore, the ferrite may be substantially rectangular or substantially circular when viewed from above. Moreover, the capacitances C1 and C2 of the first and second matching capacitors are preferably set so as to be optimized with and correspond to the inductances L1 and L2 of the first and second central electrodes, respectively.

Because of the above-described unique construction, when the inductance L1 of the first central electrode is less than the inductance L2 of the second central electrode (in the case of $L1<L2$), as the difference between L1 and L2 increases, the isolation bandwidth decreases and the insertion loss bandwidth increases. On the contrary, when the inductance L1 of the first central electrode is greater than the inductance L2 of the second central electrode (in the case of $L1>L2$), as the difference between L1 and L2 increases, the isolation bandwidth increases and the insertion loss bandwidth decreases.

Furthermore, in a two-port isolator of preferred embodiments of the present invention, a metal case which encloses the permanent magnet, the ferrite, and the first and second central electrodes is provided. The metal case includes a top surface portion, a bottom surface portion, and a pair of opposing side surface portions joining the top surface portion and bottom surface portion, one of the first central electrode and second central electrode is disposed so as to be substantially perpendicular to the side surface portions, and the other central electrode is arranged so as to be substantially parallel to the side surface portions.

Because of the above-described construction, in the central electrode arranged so as to be substantially perpendicular to the side surface portions which join the top surface portion and bottom surface portion of the metal case, a grounding current easily flows to the top and bottom surface portions, and, in the central electrode arranged so as to be substantially parallel to the side surface portions, no substantial grounding current flows to the top and bottom surface portions. Therefore, even if the first central electrode and second central electrode have the same shape, the two inductances L1 and L2 can be made different from one another.

Moreover, the first external input-output electrode which is electrically connected to the first input-output port and the second external input-output electrode which is electrically connected to the second input-output port may be provided in the middle of a pair of opposing side surfaces of the two-port isolator. In this way, when a two-port isolator is mounted on a printed-circuit board in portable telephones, for example, when the two-port isolator is turned around by 180 degrees, it is possible to mount the two-port isolator on a printed-circuit board in which a signal input line and a signal output line are opposite to each other on the right side and left side. Accordingly, it is unnecessary to provide two-port isolators having different configurations in accordance with the direction of the signal input line and signal output line on the printed-circuit board.

Furthermore, a communication device according to another preferred embodiment of the present invention, in which the above-described two-port isolator is provided, exhibits greatly improved characteristics as compared with communication device which include conventional two-port isolators.

Other features, elements, characteristics and advantages of the present invention will become more apparent from the following detailed description of preferred embodiments of the present invention with reference to the attached drawings.

DETAILED DESCRIPTION OF PREFERRED EMBODIMENTS

Hereinafter, preferred embodiments of a two-port isolator and communication device according to the present invention will be described with reference to the accompanying drawings.

First Preferred Embodiment

Figure 1:
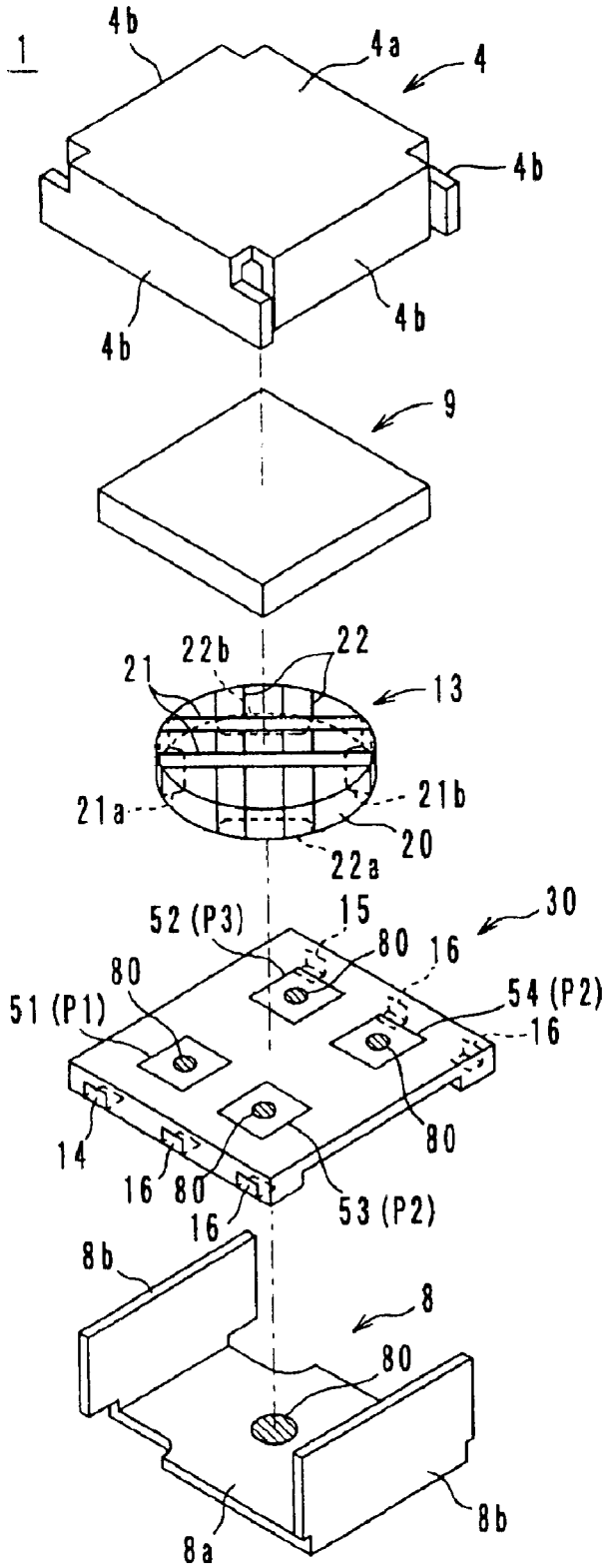
FIG. 1 is an exploded perspective view showing a preferred embodiment of a two-port isolator of the present invention.

FIG. 1 shows an exploded perspective view of a first preferred embodiment of a two-port isolator of the present invention. The two-port isolator 1 is preferably a lumped-constant isolator. As shown in FIG. 1, the two-port isolator 1 includes a metal case including an upper metal case 4 and a lower metal case 8, a permanent magnet 9, a central electrode assembly 13 made of a ferrite 20 and central electrodes 21 and 22, and a laminated substrate 30.

The upper metal case 4 is substantially box-shaped including a top surface portion 4*a* and four side surface portions 4*b*. The lower metal case 8 includes a bottom surface portion 8*a* and left and right side surface portions 8*b*. Since the upper metal case 4 and the lower metal case 8 define a magnetic circuit, they are made of a ferromagnetic material such as, for example, soft iron, and surfaces thereof are plated with silver or gold.

In the central electrode assembly 13, first and second central electrodes 21 and 22 are disposed on the top surface of the disk-shaped microwave ferrite 20, such that the first and second central electrodes 21 and 22 intersect each other substantially at right angles with an insulating layer (not illustrated) disposed therebetween. In the present preferred embodiment, the central electrodes 21 and 22 are preferably configured as two straight lines. Both end portions 21*a* and 21*b*, and 22*a* and 22*b* of the first central electrode 21 and the second central electrode 22 extend so as to reach the bottom surface of the ferrite 20 and the end portions 21*a* to 22*b* are separated from each other.

Figure 2:
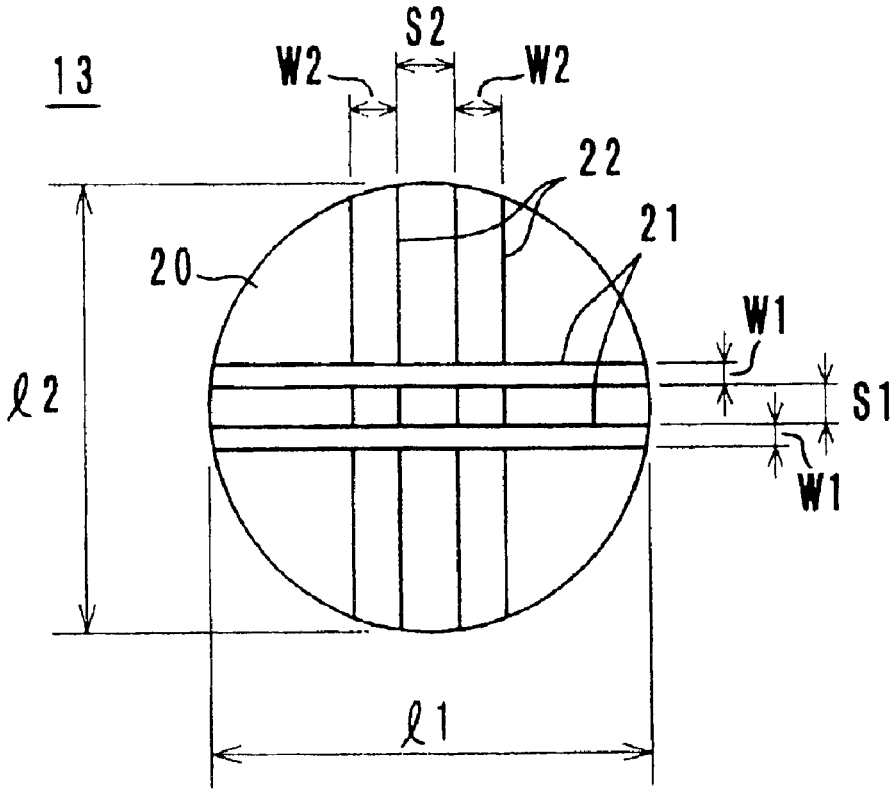
FIG. 2 is a top view of the central electrode assembly shown in FIG. 1.

As shown in FIG. 2, the electrode width W1 of the first central electrode 21 and the electrode width W2 of the second central electrode 22 are different from each other. Thus, the inductance L1 of the first central electrode 21 is different from the inductance L2 of the second central electrode 22. In the present preferred embodiment, although the inductances L1 and L2 are made different from each other by using the different electrode widths W1 and W2, the method of differentiation is not limited thereto. For example, the inductances L1 and L2 may be made different from each other by making the electrode thickness t1 of the first central electrode 21 different from the electrode thickness t2 of the second central electrode 22, by making the electrode length l1 of the first central electrode 21 different from the electrode length 12 of the second central electrode 22, by making the spacing S1 between electrodes of the first central electrode 21 different from the spacing S2 between electrodes of the second central electrode 22, or by a combination thereof.

Here, as the electrode widths W1 and W2 of the central electrodes 21 and 22 decrease, the inductances L1 and l2 increases. Furthermore, as the electrode thicknesses t1 and t2 decrease, the inductances L1 and l2 increases. Moreover, as the electrode lengths l1 and L2 increase, the inductances L1 and l2 increase. Moreover, as the spacing S1 and S2 between the electrodes decreases, the inductances L1 and l2 increases.

The central electrodes 21 and 22 may be wound around the ferrite 22 using a copper foil, or may be formed by printing silver paste on the ferrite 20 or inside the ferrite 20. Or, the central electrodes 21 and 22 may be formed by using a laminated substrate, as described in Japanese Unexamined Patent Application Publication No. 9-232818. However, since the printed central electrodes 21 and 22 have a higher positional accuracy, the connection to the laminated substrate 30 is greatly improved. In particular, when the connection is made by using extremely small connection electrodes 51 to 54 for the central electrodes (to be described later), the central electrodes 21 and 22 formed by printing are reliable and workable.

Figure 3:
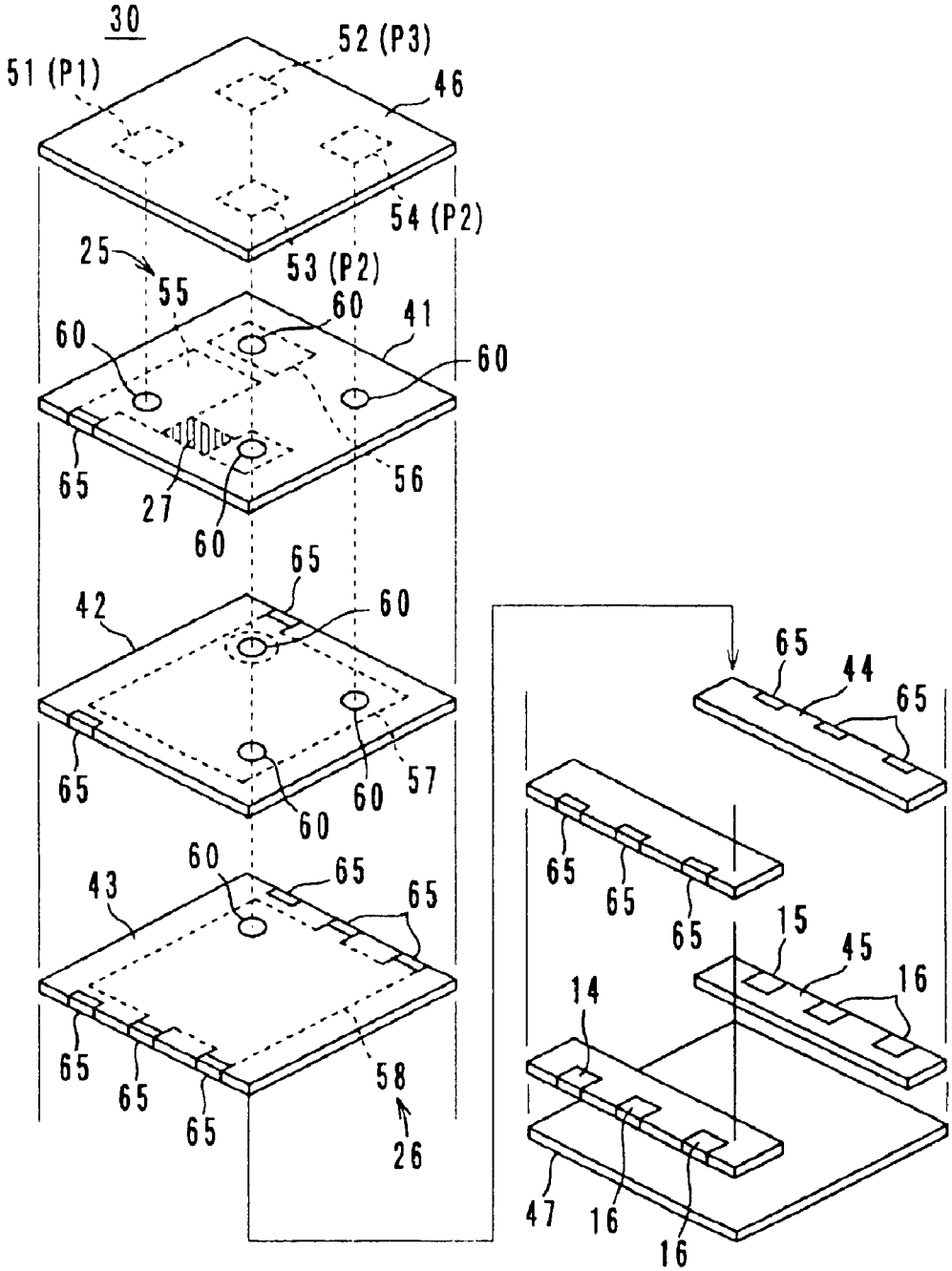
FIG. 3 is an exploded perspective view of the laminated substrate shown in FIG. 1.

As shown in FIG. 3, the laminated substrate 30 includes the connection electrodes 51 to 54 for the central electrodes, a dielectric sheet 41 on the bottom surface of which capacitor electrodes 55 and 56 and a resistor 27 are provided, a dielectric sheet 42 on the bottom surface of which a capacitor electrode 57 is provided, a dielectric sheet 43 on the bottom surface of which a grounding electrode 58 is provided, and a dielectric sheet 45 on the surface of which an external input electrode 14, an external output electrode 15, and an external grounding electrode 16 are provided. The connection electrode 51 for the central electrodes defines an input port P1, the connection electrodes 53 and 54 for the central electrodes define an output port P2, and the connection electrode 52 for the central electrodes defines a third port P3.

The laminated substrate 30 is preferably produced as follows. Dielectric sheets 41 to 45 are preferably made of low-temperature sintered material including $Al_2O_3$ as a main component and one or a plurality of $SiO_2$, SrO, CaO, PbO, $Na_2O$, $K_2O$, MgO, BaO, $CeO_2$, and $B_2O_3$ as secondary components.

Furthermore, shrinkage-suppressing sheets 46 and 47 that are not fired at firing conditions for the laminated substrate 30, particularly at a temperature of about 1000° C. or less and suppress firing shrinkage in the planar direction (the X-Y direction) are provided. The shrinkage-suppressing sheets 46 and 47 are preferably made of a mixture of alumina powder and stabilized zirconia powder. The thickness of the sheets 41 to 47 is preferably, for example, about 10 $\mu$m to about 200 $\mu$m.

The electrodes 51 to 58 are formed on the bottom surface of the sheets 41 to 43 and 46 by a method of pattern printing, or other suitable method. The electrodes 51 to 58, are made of a material, for example, Ag, Cu, Ag—Pd, having a low resistivity, which can be simultaneously fired with the dielectric sheets 51 to 58. The thickness of the electrodes 51 to 58 is preferably, for example, about 2 $\mu$m to about 20 $\mu$m. Normally, the thickness of the electrodes 51 to 58, is at least about two times the skin depth.

The resistor 27 is formed on the bottom surface of the dielectric sheet 41 preferably by a method of pattern printing. As a material for the resistor, cermet, carbon, ruthenium, or other suitable materials are preferably used. The resistor 27 may be formed by printing on the top surface of the laminated substrate 30, or may be formed as a chip resistor.

Via holes 60 and 65 on the side surface, and external electrodes 14 to 16 are formed such that, after via holes have been formed in the dielectric sheets 41 to 45 via laser machining, punching, or other suitable method, conductive paste is filled in the via holes.

The capacitor electrode 57, which is opposed to the capacitor electrode 55 so as to sandwich the dielectric sheet 42, defines a matching capacitor 25. Furthermore, the capacitor electrode 57, which is opposed to the capacitor electrode 56 and the grounding electrode 58 so as to sandwich the dielectric sheets 42 and 43, defines a matching capacitor 26. These matching capacitors 25 and 26 and the resistor 27 together with the electrodes 51 to 54, the external electrodes 14 to 16, and the via holes 60 and 65 define an electric circuit inside the laminated substrate 30.

The dielectric sheets 41 to 45 are laminated, and, after the laminated dielectric sheets 41 to 45 are sandwiched from the top and bottom sides by the shrinkage-suppressed sheets 46 and 47, the dielectric sheets 41 to 45 are fired. In this manner, a fired body is obtained, and, after any shrinkage-suppressing material which is not fired has been removed by ultrasonic cleaning and wet honing, the laminated substrate 30 shown in FIG. 1 is produced.

On both end portions of the laminated substrate 30, the external input electrode 14, external output electrode 15, and external grounding electrode 16 are formed. The external input electrode 14 is electrically connected to the capacitor electrode 55, and the external output electrode 15 is electrically connected to the capacitor electrode 57. The external grounding electrodes 16 are electrically connected to the grounding electrode 58. After that, gold plating is applied on a nickel plating to define a ground. The nickel plating increases the fixing strength of the silver and gold plating of the electrodes. The gold plating improves the solder wettability and, since the gold plating has outstanding conductivity, the isolator 1 has reduced loss.

Moreover, this laminated substrate 30 is usually made as a mother board. Half-cut grooves having a fixed pitch are formed on the mother board and a laminated substrate 30 having a desired size is obtained by breaking the mother board along the half-cut groove. Or a laminated substrate 30 having a desired size may be cut out by breaking the mother board with a dicer, laser, or other suitable device.

The laminated substrate 30 obtained in this manner includes the matching capacitors 25 and 26 and the resistor 27 inside the laminated substrate 30. The matching capacitors 25 and 26 are formed so as to have capacitances of a required accuracy. However, if required, trimming of the laminated substrate 30 takes place before the matching capacitors 25 and 26 and the central electrodes 21 and 22 are connected. That is, in the laminated substrate 30, the inner capacitor electrodes 55 and 56 (in the second layer) are trimmed together with the dielectric body in the surface layer. For example, a cutting machine and YAG laser machine using the fundamental wave, frequency-doubled wave, and frequency-triple wave are used. When a laser is used, the processing is quickly and precisely performed. Moreover, trimming of the laminated substrate 30 in the mother board may be performed effectively.

Thus, since the capacitor electrodes 55 and 56 located close to the top surface of the laminated substrate 30 are trimmed, the thickness of the dielectric layer to be removed during trimming is minimized. Moreover, since the number of electrodes, which hinders trimming, is minimized (only the connection electrodes 51 to 54 in the present preferred embodiment), the area of capacitor electrodes which can be trimmed is increased, and accordingly, the range of adjustment of the capacitance is greatly increased.

Furthermore, since the resistor 27 is also included in the laminated substrate 30, the resistance value R of the resistor 27 can also be adjusted by trimming the resistor 27 together with the dielectric body on the surface in the same manner as the matching capacitors 25 and 26. In the resistor 27, as the width is reduced even at one location, the resistance value R increases, and accordingly, the width is cut at most halfway.

As shown in FIG. 1, the permanent magnet 9 is attached to the ceiling of the upper metal case 4 via adhesive. The central electrode assembly 13 is mounted on the laminated substrate 30 such that the terminal portions 21*a* to 22*b* of the central electrodes 21 and 22 are electrically connected to the connection electrodes 51 to 54 for the central electrodes, which are formed on the surface of the laminated substrate 30. Moreover, soldering of the connection electrodes 51 to 54 to the central electrodes 21 and 22 is effectively performed while the laminated substrate 30 is still a portion of the mother board, or not cut out from the mother board.

The laminated substrate 30 is mounted on the bottom surface 8*a* of the lower metal case 8 and the grounding electrode 58 provided on the lower surface of the laminated substrate 30 is connected and fixed to the bottom surface 8*a* by soldering 80. Thus, the grounding port 16 is easily electrically connected to the bottom surface 8*a*.

Then, the lower metal case 8 and the upper metal case 4 define a metal case when the side portions 8*b* and 4*b* are joined by soldering and function as a yoke. That is, this metal case forms a magnetic path surrounding the permanent magnet 9, the central electrode assembly 13, and the laminated substrate 30. Furthermore, the permanent magnet 9 applies a DC magnetic field to the ferrite 20.

Figure 4:
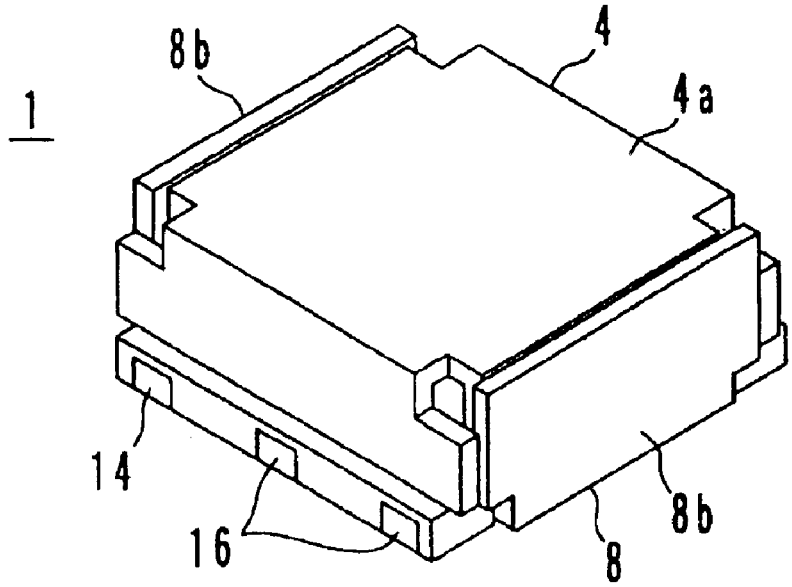
FIG. 4 is an outer perspective view of the two-port isolator shown in FIG. 1.
Figure 5:
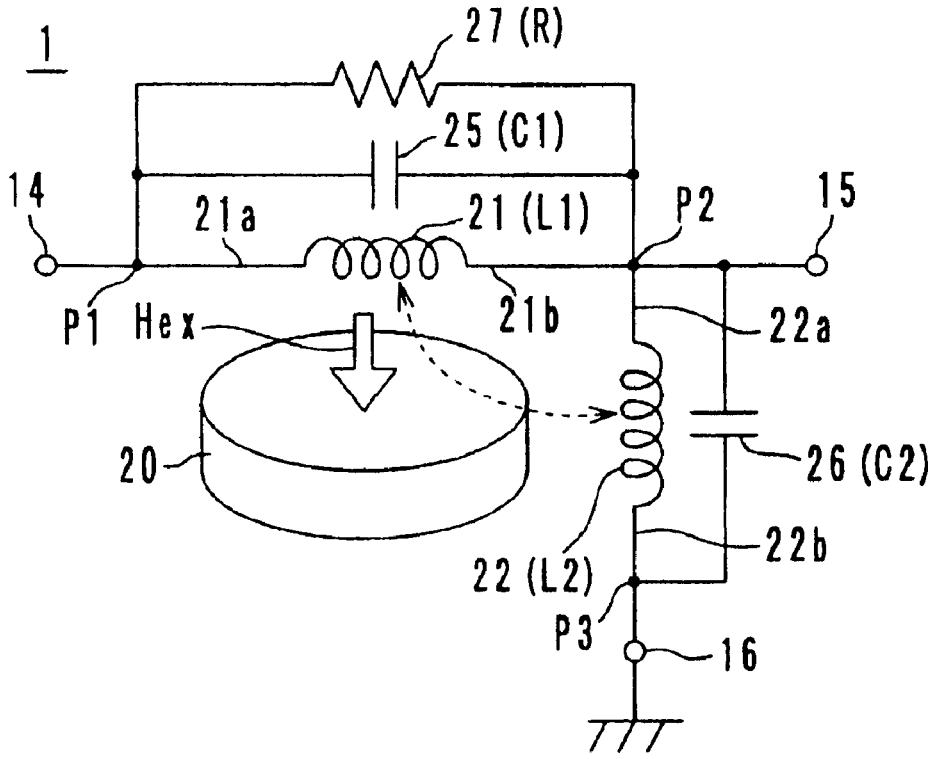
FIG. 5 is an electrical equivalent circuit diagram of the two-port isolator shown in FIG. 1.
Figure 6:
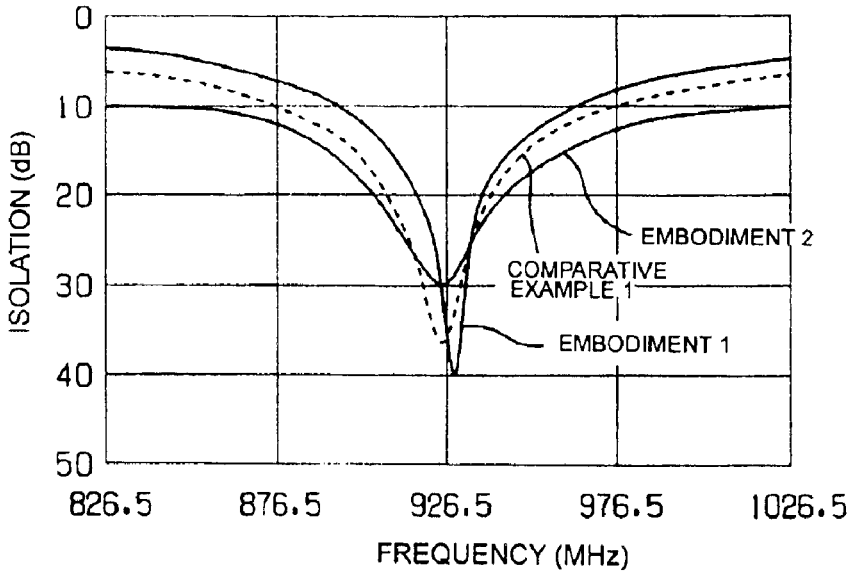
FIG. 6 is a graph showing isolation characteristics.
Figure 7:
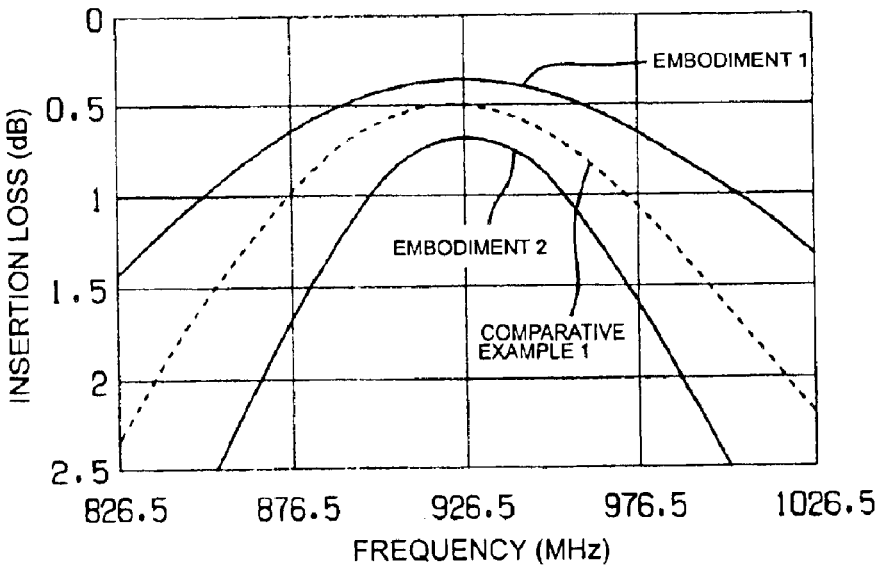
FIG. 7 is a graph showing insertion loss characteristics.
Figure 8:
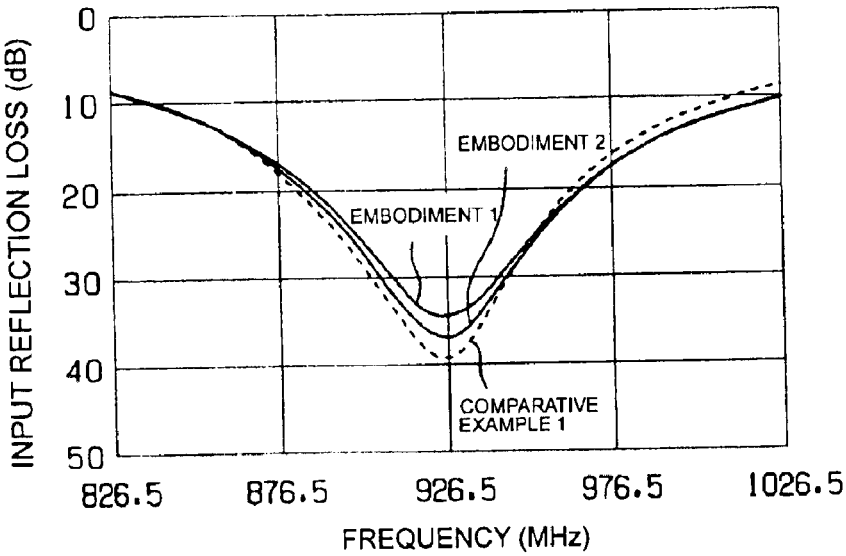
FIG. 8 is a graph showing input reflection loss characteristics.
Figure 9:
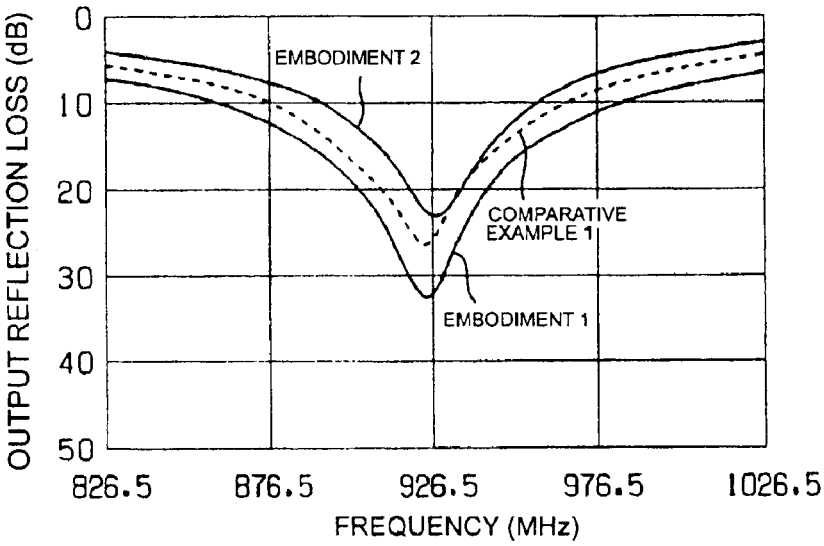
FIG. 9 is a graph showing output reflection loss characteristics.

In this manner, the two-port isolator shown in FIG. 4 is obtained. FIG. 5 is an electrical equivalent circuit diagram of the isolator 1. One end portion 21*a* of the first central electrode 21 is electrically connected to the external input electrode 14 through the input port P1 (connection electrode 51 for the central electrodes). The other end portion 21*b* of the first central electrode 21 is electrically connected to the external output electrode 15 via the output port P2 (connection electrode 54 for the central electrodes). One end portion 22*a* of the second central electrode 22 is electrically connected to the external output electrode 15 via the output port P2 (connection electrode 53 for the central electrodes). The other end portion 22*b* of the second central electrode 22 is electrically connected to the external grounding electrode 16 through the third port P3 (connection electrode 52 for the central electrodes). A parallel RC circuit including the matching capacitor 25 and the resistor 27 is electrically connected between the input port P1 and the output port P2. The matching capacitor 26 is electrically connected between the output port P2 and the third port P3. The third port P3 is electrically connected to ground.

In the two-port isolator having the above-described configuration, the inductance L1 of the first central electrode 21 and the inductance L2 of the second central electrode 22 are different from each other, and, in the case of L1<L2, when the difference between L1 and L2 is increased, the isolation bandwidth decreases and the insertion loss bandwidth increases. On the contrary, in the case of L1>L2, when the difference between L1 and L2 is increased, the bandwidth for isolation increases and the bandwidth of insertion loss decreases. That is, the isolation bandwidth and the insertion loss bandwidth can be adjusted to conform with the requirements of the communication system by adjusting the values of L1 and L2.

On the other hand, when the inductance values L1 and L2 of the central electrodes 21 and 22 are different from each other, the capacitances C1 and C2 of the matching capacitors 25 and 26 must be different from each other (to set optimal capacitances C1 and C2). That is, the parallel resonance circuit including L1 and C1 and the parallel resonance circuit including L2 and C2 must have the same resonance frequency. Therefore, in preferred embodiments of the present invention, the matching capacitors 25 and 26 are provided by using the electrodes 55 to 58 provided inside the laminated substrate 30. Thus, the capacitances C1 and C2 of the matching capacitors 25 and 26 are easily made different from each other by making the opposing areas, spacings, etc., of the electrodes 55 to 58 different.

FIGS. 6 to 9 show the isolation characteristics, insertion loss characteristics, input reflection loss characteristics, and output reflection loss characteristics, respectively, when the inductances L1 and L2 of the first and second central electrodes 21 and 22 and the capacitances C1 and C2 of the matching capacitors 25 and 26 of the two-port isolator 1 are changed as shown in Table 1-1.

Here, a ferrite 20, which has a diameter of about 2.0 mm and a thickness of about 0.4 mm was used. The self-inductance was set to be about 0.7 nH by setting the electrode width W of the central electrodes 21 and 22 to about 0.2 mm, the electrode spacing S to about 0.2 mm, and the electrode length l to about 2 mm. Furthermore, the self-inductance was set to about 0.5 nH by setting the electrode width W of the central electrodes 21 and 22 to about 0.5 mm, the electrode spacing S to about 0.2 mm, and the electrode length l to about 2 mm. Moreover, the self-inductance was set to about 1.0 nH by setting the electrode width W of the central electrodes 21 and 22 to about 0.1 mm, the electrode spacing S to about 0.1 mm, and the electrode length l to about 2 mm. The resistance value of the resistor 27 was set to about 60 Ω in all cases. The inductances in Table 1-1 show the self-inductances of the central electrodes 21 and 22 when the relative magnetic permeability was assumed to be about 1, and the inductances L1 and L2 were obtained when the inductances were multiplied by the effective permeability of the ferrite 20. Furthermore, the worst values in the band of 893 MHz to 960 MHz are summarized in Table 1-2.

TABLE 1-1

| | Self-inductance of first central electrode 21 | Self-inductance of second central electrode 22 | Capacitance C1 of matching capacitor 25 | Capacitance C2 of matching capacitor 26 |
|---|---|---|---|---|
| Comparative example 1 | 0.7 nH | 0.7 nH | 22 pF | 22 pF |
| Preferred Embodiment 1 | 0.5 nH | 1.0 nH | 32 pF | 15 pF |
| Preferred Embodiment 2 | 1.0 nH | 0.5 nH | 15 pF | 32 pF |

TABLE 1-2

| | Input reflection loss (dB) | Insertion loss (dB) | Isolation (dB) | Output reflection loss (dB) |
|---|---|---|---|---|
| Comparative example 1 | 22.4 | 0.75 | 12.2 | 11.8 |
| Preferred Embodiment 1 | 23.0 | 0.47 | 9.5 | 14.8 |
| Preferred Embodiment 2 | 22.6 | 1.18 | 15.5 | 9.6 |

From FIGS. 6 to 9 and Table 1-2, when the self-inductance of the first central electrode 21 is less than the self-inductance of the second central electrode 22, as in the first preferred embodiment, although the isolation is deteriorated, the insertion loss and reflection loss are greatly improved.

On the contrary, as in preferred embodiment 2, when the self-inductance of the first central electrode 21 is greater than the self-inductance of the second central electrode 22, although the insertion loss and reflection loss are deteriorated, the isolation is greatly improved.

In this way, when the self-inductance of the two central electrodes 21 and 22 are made different from each other, the insertion loss and isolation can be optimized to provide an isolator 1 having excellent characteristics.

Figure 10:
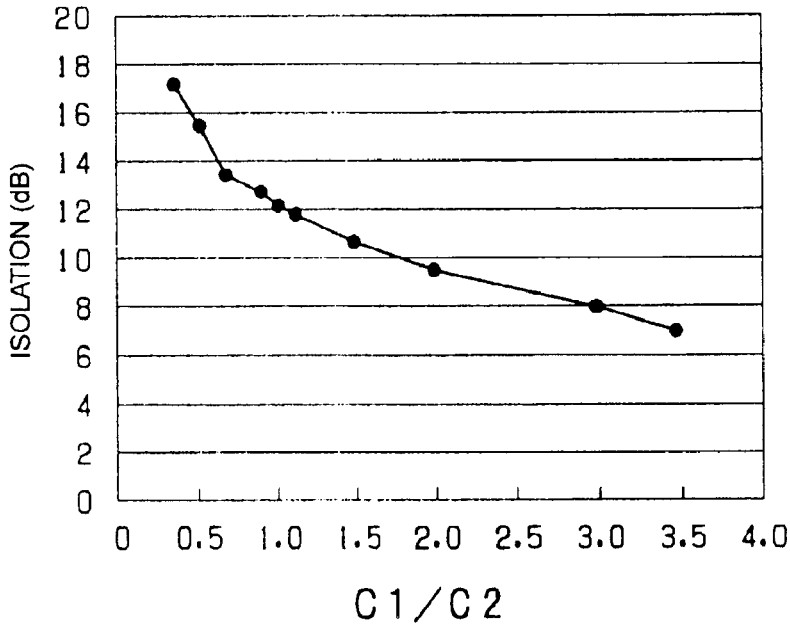
FIG. 10 is a graph showing the relationship between the ratio C1/C2 and isolation.
Figure 11:
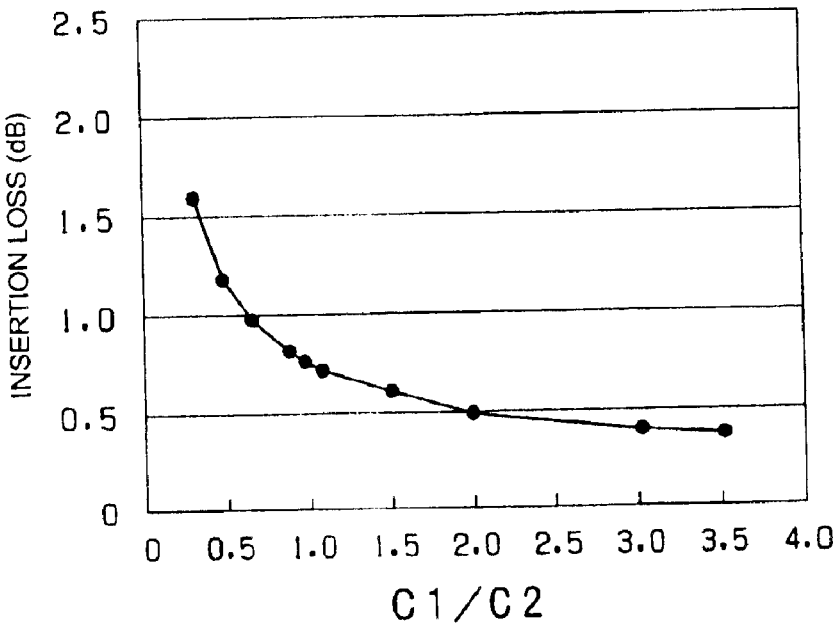
FIG. 11 is a graph showing the relationship between the ratio C1/C2 and insertion loss.
Figure 12:
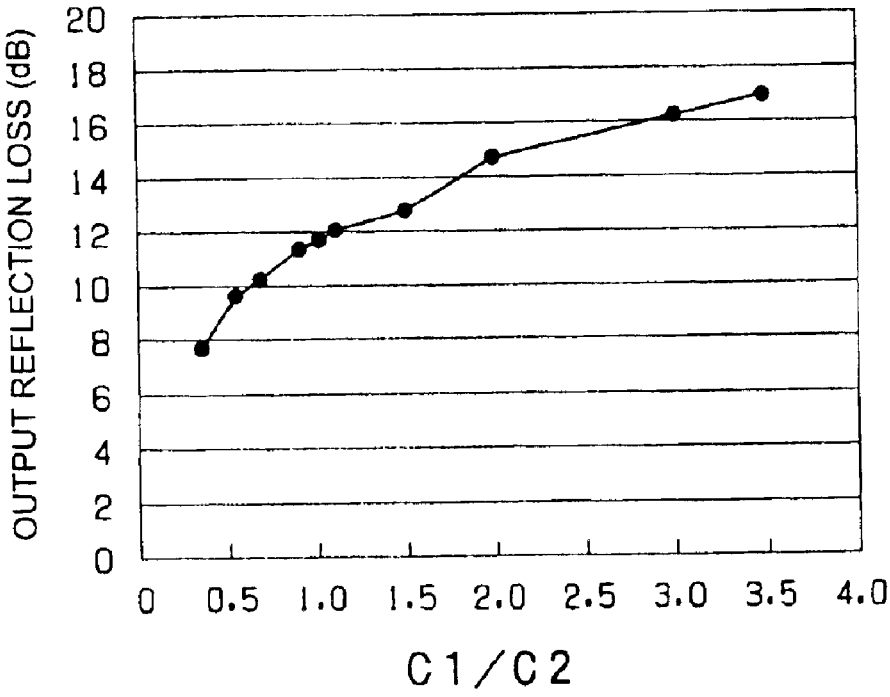
FIG. 12 is a graph showing the relationship between the ratio C1/C2 and output reflection loss.

Normally, the insertion loss required in a two-port isolator used in the mobile communication equipment is about 1.2 dB or less and the isolation is at least about 8.0 dB. Then, two-port isolators 1 meeting these conditions were investigated by changing the capacitance ratio C1/C2 of the matching capacitors 25 and 26. Table 2 shows the results, and FIGS. 10 to 12 are graphs showing the isolation characteristic, insertion loss characteristic, and output reflection characteristic, respectively.

TABLE 2

| C1/C2 | Input reflection loss (dB) | Insertion loss (dB) | Isolation (dB) | Output reflection loss (dB) |
|---|---|---|---|---|
| 0.33 | 22.70 | 1.60 | 17.20 | 7.70 |
| 0.50 | 22.60 | 1.18 | 15.50 | 9.60 |
| 0.66 | 22.00 | 0.97 | 13.50 | 10.30 |

TABLE 2-continued

| C1/C2 | Input reflection loss (dB) | Insertion loss (dB) | Isolation (dB) | Output reflection loss (dB) |
|---|---|---|---|---|
| 0.90 | 22.10 | 0.80 | 12.70 | 11.40 |
| 1.00 | 22.40 | 0.75 | 12.20 | 11.80 |
| 1.10 | 22.10 | 0.70 | 11.80 | 12.10 |
| 1.50 | 22.20 | 0.60 | 10.60 | 12.90 |
| 2.00 | 23.00 | 0.47 | 9.50 | 14.80 |
| 3.00 | 23.20 | 0.38 | 8.00 | 16.20 |
| 3.50 | 24.00 | 0.35 | 7.10 | 16.90 |

As shown in Table 2 and FIGS. 10 and 11, in the range where the insertion loss is about 1.2 dB or less and the isolation is at least about 8.0 dB, when a two-port isolator 1 having excellent isolation is required, it is desirable to design it such that the value of C1/C2 satisfies the expression, $0.5 \leqq C1/C2 \leqq 0.9$. This is because the isolation is improved by about 0.5 dB when C1/C2 is about 0.9 or less. However, when C1/C2 is less than about 0.5, although the isolation is further improved, the insertion loss exceeds about 1.2 dB and the isolator cannot be used in practice.

Furthermore, in the range where the insertion loss is about 1.2 dB or less and the isolation is at least about 8.0 dB, when a two-port isolator 1 having excellent isolation is required, it is desirable to design it such that the value of C1/C2 satisfies the expression $1.1 \leqq C1/C2 \leqq 3.0$. This is because the insertion loss is improved by about 0.05 dB when C1/C2 is at least about 1.1. However, when C1/C2 exceeds about 3.0, although the insertion loss is further improved, the isolation exceeds about 8.0 dB and the isolator cannot be used in practice.

Moreover, in the case of three-port isolators (isolators having three central electrodes), as described in Japanese Unexamined Patent Application Publication No. 2001-185914, Japanese Unexamined Patent Application Publication No. 2001-203507, and Japanese Unexamined Patent Application Publication No. 2001-203508, the configuration in which the inductances of the central electrodes are made different from each other is well-known. However, in these three-port isolators, the asymmetrical configuration is adjusted by changing the electrode widths, etc.

In contrast, in preferred embodiments of the present invention, an asymmetrical configuration is used and the isolation and insertion loss are set so as to have the desired characteristics. In the three-port isolators, even if the thicknesses of the central electrodes are different from one another, the isolation bandwidth and the insertion loss bandwidth cannot be adjusted to offset each other. Only a two-port isolator according to preferred embodiments of the present invention in which the input-output ports P1 and P2 are connected to both end portions 21*a* and 21*b* of the central electrode 21 achieves such an effect.

Second Preferred Embodiment

Figure 13:
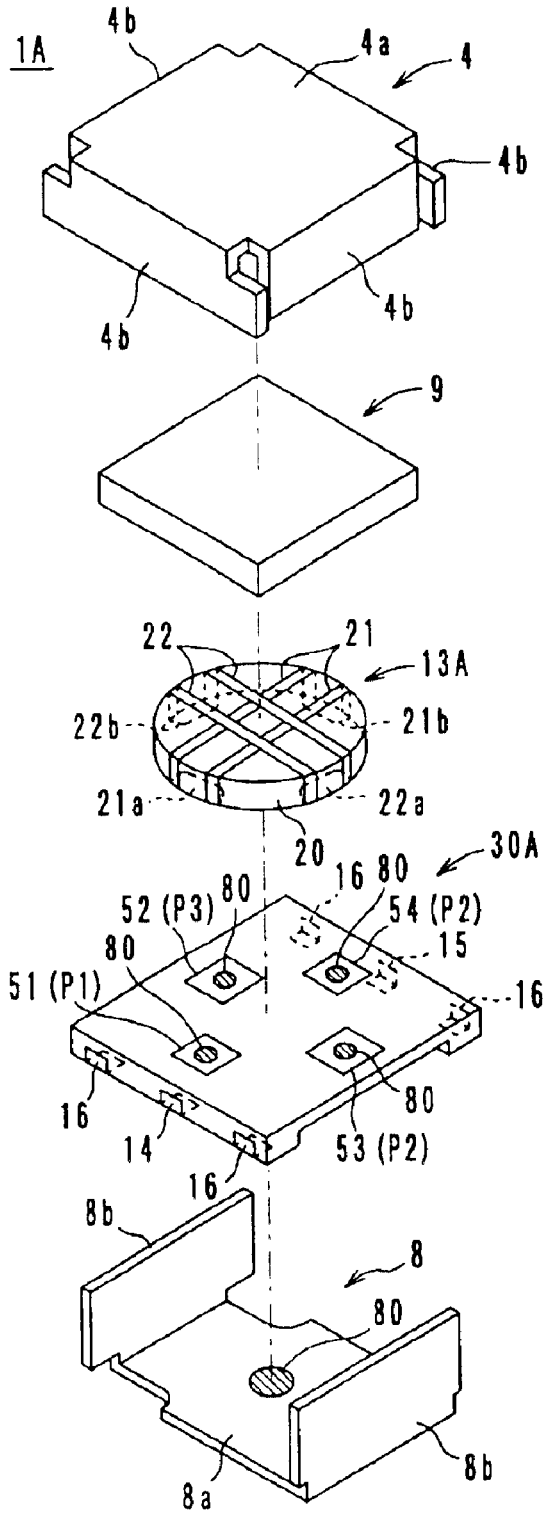
FIG. 13 is an exploded perspective view showing another preferred embodiment of a two-port isolator of the present invention.

A two-port isolator 1A shown in FIG. 13 preferably has the same configuration as the two-port isolator according to the first preferred embodiment except for a central electrode assembly 13A and a laminated substrate 30A.

In the central electrode assembly 13A, first and second central electrodes 21 and 22 are disposed on the top surface of the ferrite 20 so as to intersect each other with an insulation layer disposed (not illustrated) therebetween. The first and second central electrodes 21 and 22 preferably have the same shape (electrode width, electrode thickness, electrode length, and spacing between electrodes).

Figure 14:
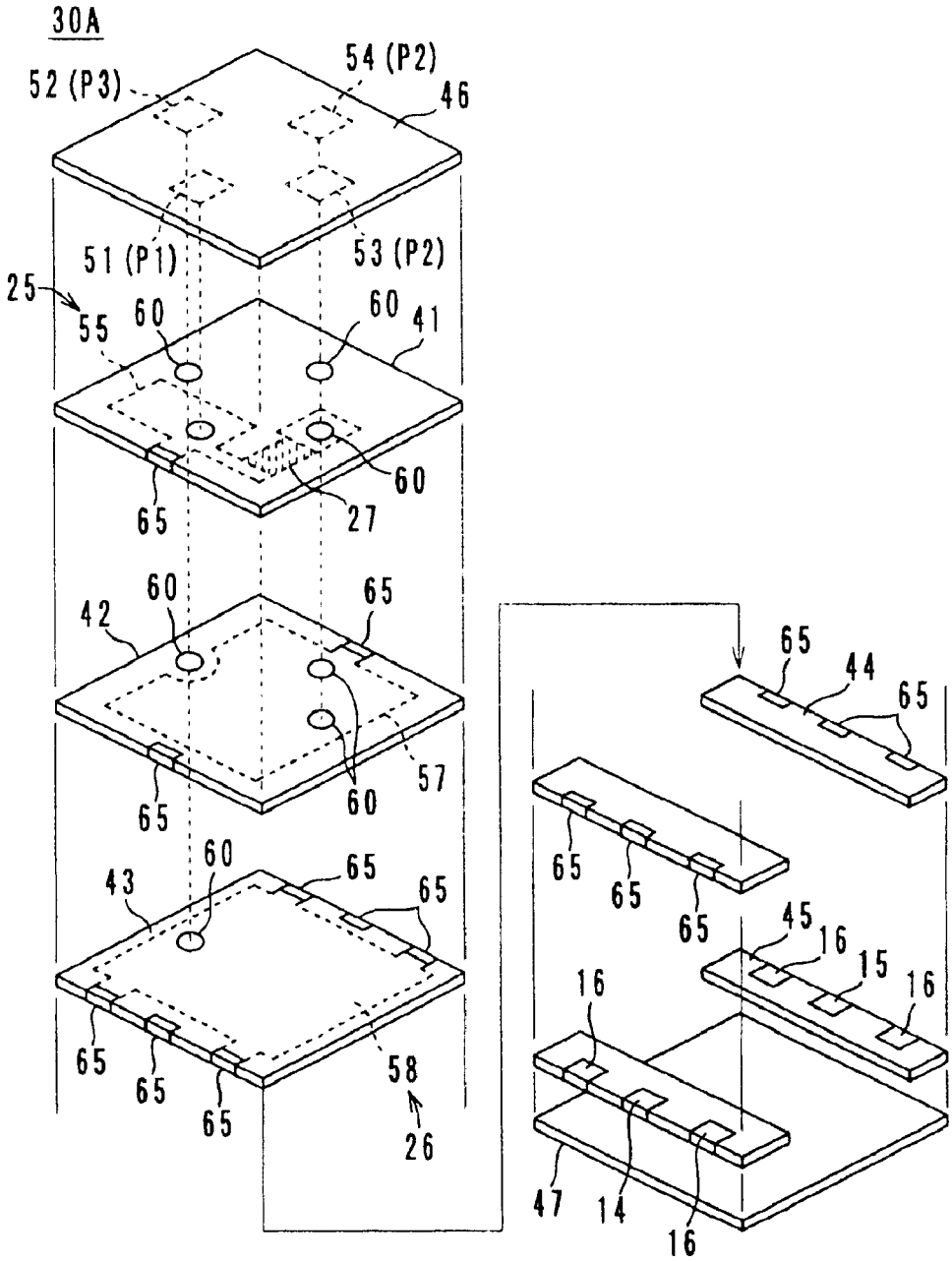
FIG. 14 is an exploded perspective view of the laminated substrate shown in FIG. 13.

As shown in FIG. 14, the laminated substrate 30A includes connection electrodes 51 to 54 for the central electrodes, a dielectric sheet 41 on the bottom surface of which a capacitor electrode 55 and a resistor 25 are provided, a dielectric sheet 42 on the bottom surface of which a capacitor electrode 57 is provided, a dielectric sheet 43 on the bottom surface of which a grounding electrode 58 is provided, a dielectric sheet 45 on which an external input electrode 14, an external output electrode 15, and an external grounding electrode 16 are provided, and others. This laminated substrate 30A is preferably produced in the same way as the laminated substrate 30 of the first preferred embodiment of the present invention.

The capacitor electrode 57, facing the capacitor electrode 55 with the dielectric sheet 42 therebetween, constitutes a matching capacitor 25. Furthermore, the capacitor electrode 57, facing the grounding electrode 58 with the dielectric sheet 43 therebetween, constitutes a matching capacitor 26.

The connection electrodes 51 to 54 for the central electrodes are disposed in the vicinity of the middle of the four sides of the laminated substrate 30A. Furthermore, the external input electrode 14 and the external output electrode 15 are also disposed in the middle of the two opposing sides of the laminated substrate 30A. The connection electrode 51 for the central electrodes defines an input port P1, the connection electrodes 53 and 54 for the central electrodes define output ports P2, and the connection electrode 52 for the central electrodes defines a third port P3.

The central electrode assembly 13A having the above-described configuration is mounted on the laminated substrate 30A such that either of the two central electrodes 21 and 22 is substantially perpendicular to the side surface portion 8*b* of the lower metal case 8 joined to the upper metal case 4. In the central electrode 22 disposed to be substantially perpendicular to the side surface portion 8*b*, a grounding current easily flows to the top surface portion 4*a* and the bottom surface portion 8*a*, and, in the central electrode 21 disposed so as to be substantially parallel to the side face portion 8*b*, virtually no grounding current flows to the top surface portion 4*a* and bottom surface portion 8*a* of the metal case. Therefore, even if the central electrodes 21 and 22 have the same shape, the inductances L1 and L2 thereof are different from one another.

Accordingly, the two-port isolator 1A exhibits the same advantages as the isolator 1 of the first preferred embodiment of the present invention. Moreover, a grounding current is generated in an electric power unit (not illustrated) connected to the external input and output electrodes 14 and 15 and flows through various paths in the isolator 1A. For example, a grounding current flows in a path defined by the external input electrode 14, the central electrode 21, the central electrode 22, and the external grounding electrode 16, and flows in a path defined by the external input electrode 14, the central electrode 21, the matching capacitor C2 (displacement current), and the external grounding electrode 16.

Furthermore, in the second preferred embodiment, the external input electrode 14 and the external output electrode 15 are provided in the middle of a pair of opposing side surfaces of the isolator 1A. Accordingly, when the isolator 1A is mounted on a printed circuit board in, for example, portable telephones, it is possible to mount the isolator 1A on the printed circuit board, in which a signal input line and a signal output line are provided opposite to each other on the right and left, by turning around the isolator 1A by 180 degrees. Therefore, it is unnecessary to provide two kinds of isolators 1A which are adapted to the directions of the signal input line and signal output line on the printed circuit board. As a result, the cost of the isolator 1A is greatly reduced.

In particular, in this two-port isolator 1A, the reflection loss versus frequency characteristics vary greatly between the cases where port P1 defines an input port and port P2 defines an input port, and accordingly, not only must the direction of a magnetic field (the NS direction of the permanent magnet 9) be reversed, but the inner construction must also be reversed to produce isolators 1A of two kinds. Therefore, the cost reduction effect is further enhanced.

Third Preferred Embodiment

Figure 15:
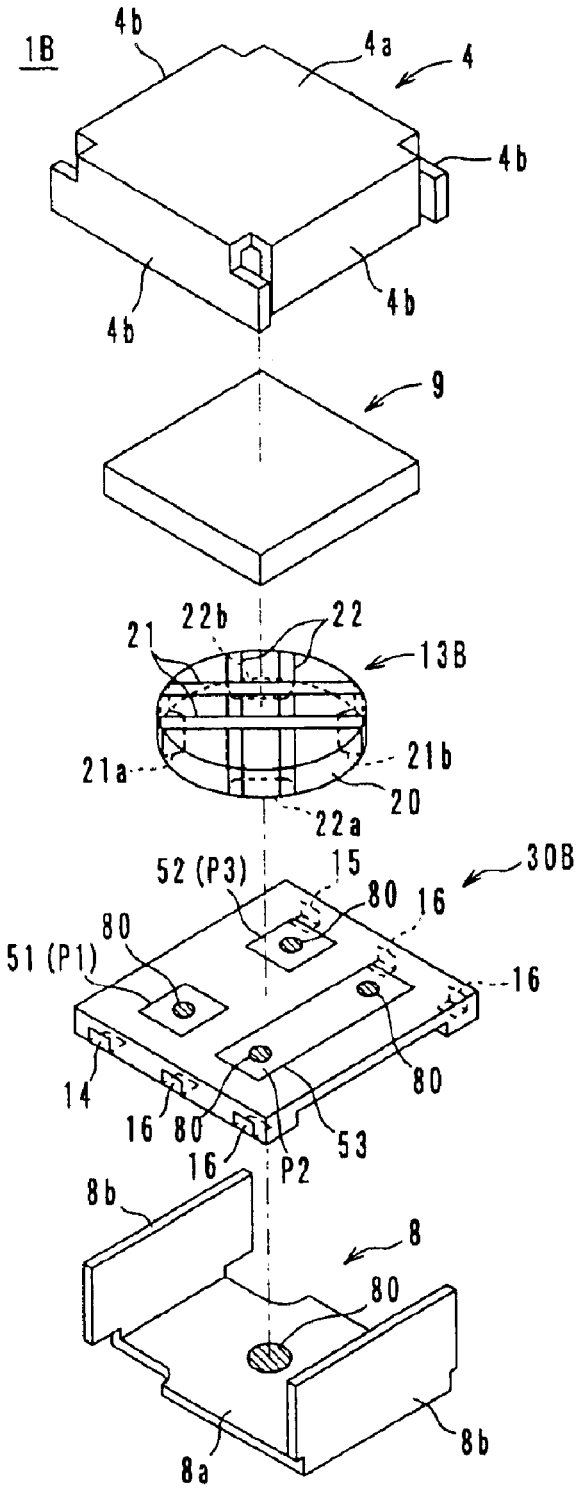
FIG. 15 is an exploded perspective view showing another preferred embodiment of a two-port isolator of the present invention.

A two-port isolator 1B shown in FIG. 15 has the same configuration as the two-port isolator of the first preferred embodiment except for a central electrode assembly 13B and a laminated substrate 30B.

In the central electrode assembly 13B, first and second central electrodes 21 and 22 are disposed on the top surface of the ferrite 20 to intersect each other with an insulation layer disposed (not illustrated) therebetween. The first and second central electrodes 21 and 22 have the same shape (electrode width, electrode thickness, electrode length, and spacing between electrodes).

Figure 16:
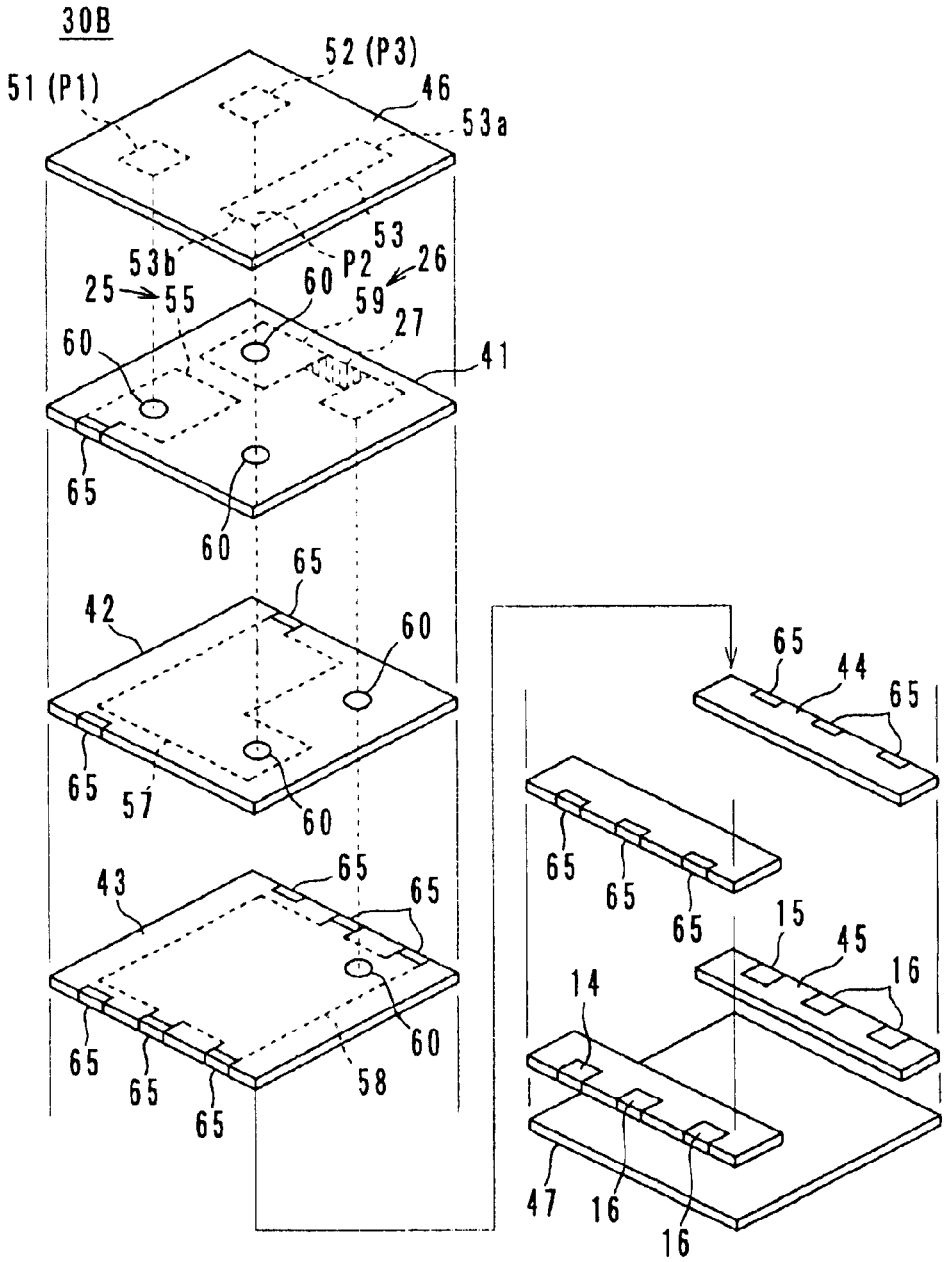
FIG. 16 is an exploded perspective view of the laminated substrate shown in FIG. 15.

As shown in FIG. 16, the laminated substrate 30B includes connection electrodes 51 to 53, a dielectric sheet 41 on the bottom surface of which capacitor electrodes 55 and 59 and a resistor 25 are provided, a dielectric sheet 42 on the bottom surface of which a capacitor electrode 57 is provided, a dielectric sheet 43 on the bottom surface of which a grounding electrode 58 is provided, a dielectric sheet 45 on which an external input electrode 14, an external output electrode 15, and an external grounding electrode 16 are provided.

The capacitor electrode 57, facing the capacitor electrodes 55 and 59 with the dielectric sheet 42 therebetween, defines matching capacitors 25 and 26, respectively.

One end portion 53*b* of a connection electrode 53 for the central electrodes, which has a long strip shape, is electrically connected to the capacitor electrode 57 through via holes 60 provided in the dielectric sheets 41 and 42. Thus, the actual electrode length of the first central electrode 21 is determined by adding the length of the first central electrode 21 and the length extending from the end portion 53*a*, at which the central electrode 21 is soldered, of the connection electrode 53 for the central electrodes to the location where the via hole is connected. The actual electrode length of the first central electrode 21 and second central electrode 22 are adjusted by changing the location of the via holes.

As a result, the real inductance L1 of the first central electrode 21 can be different from the real inductance L2 of the second central electrode 22 and accordingly, the isolation bandwidth and the insertion loss bandwidth in a two-port isolator 1B can be adjusted to be consistent with the requirements of the communication system. Moreover, in this case, the location where the connection electrode 53 for the central electrodes is connected to the via holes 60 defines the location of the output port P2. Then, the connection electrode 51 for the central electrodes defines the input port P1 and the connection electrode 52 for the central electrodes defines the third port P3.

Furthermore, the number of via holes 60 formed in the laminated substrate 30B and their connection locations can be reduced. When the number of via holes is reduced, the area for electrodes in one dielectric sheet is increased and the capacitance of the matching capacitors 25 and 26 is increased.

Figure 17:
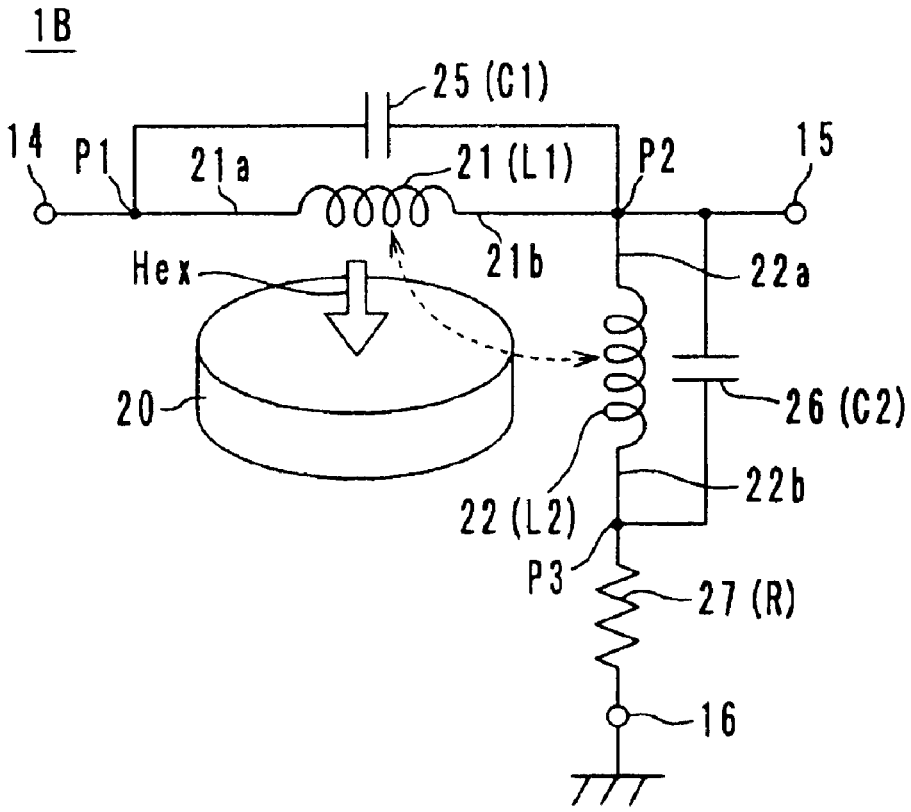
FIG. 17 is an electrical equivalent circuit diagram of the two-port isolator shown in FIG. 15.
Figure 18:
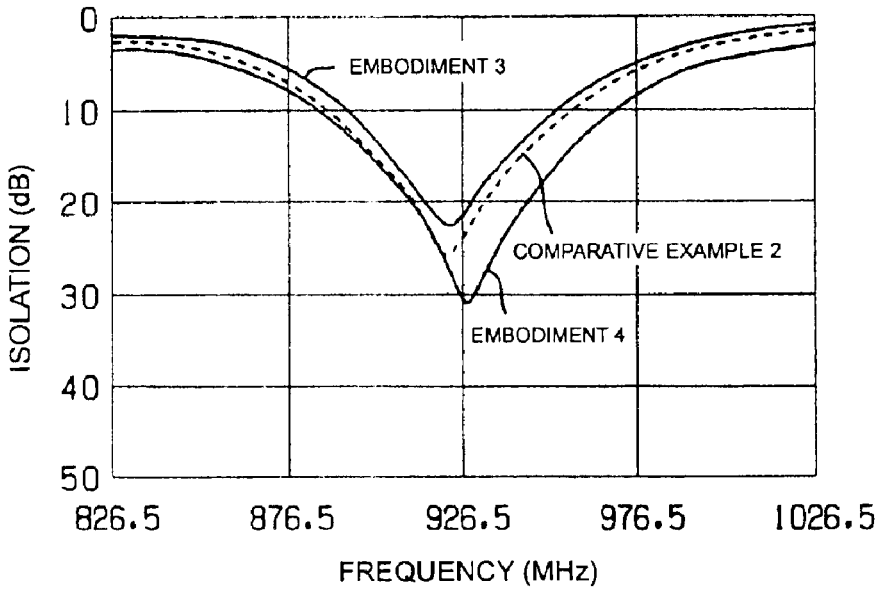
FIG. 18 is a graph showing isolation characteristics.
Figure 19:
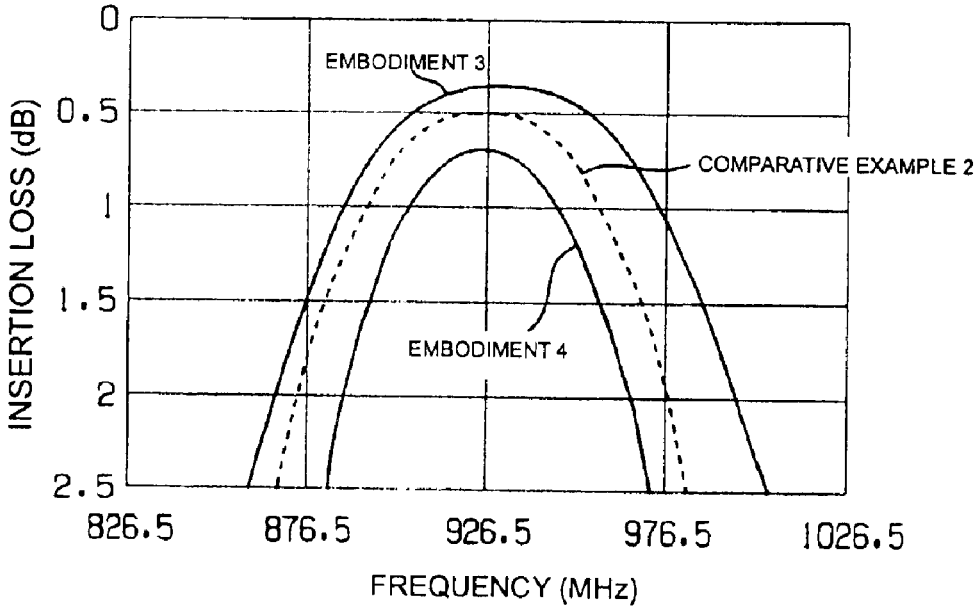
FIG. 19 is a graph showing insertion loss characteristics.
Figure 20:
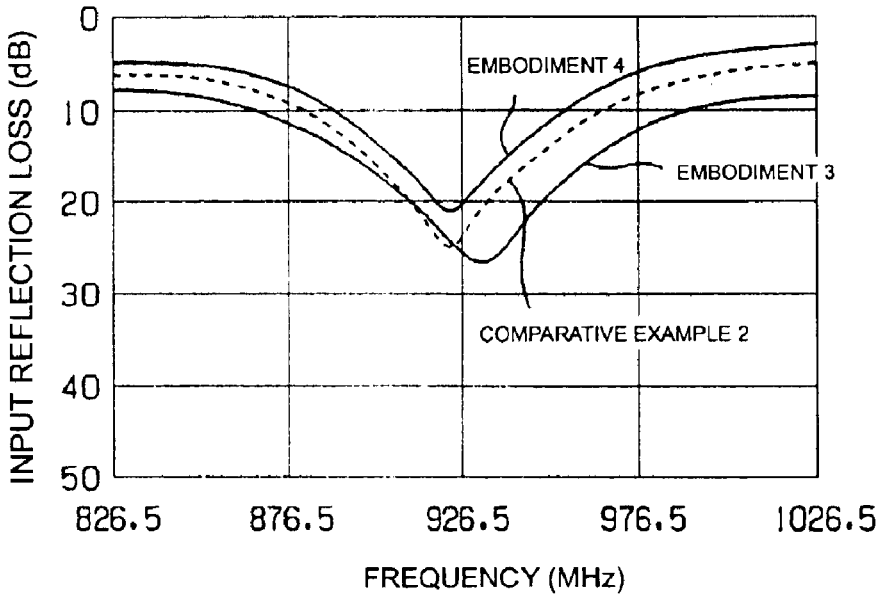
FIG. 20 is a graph showing input reflection loss characteristics.
Figure 21:
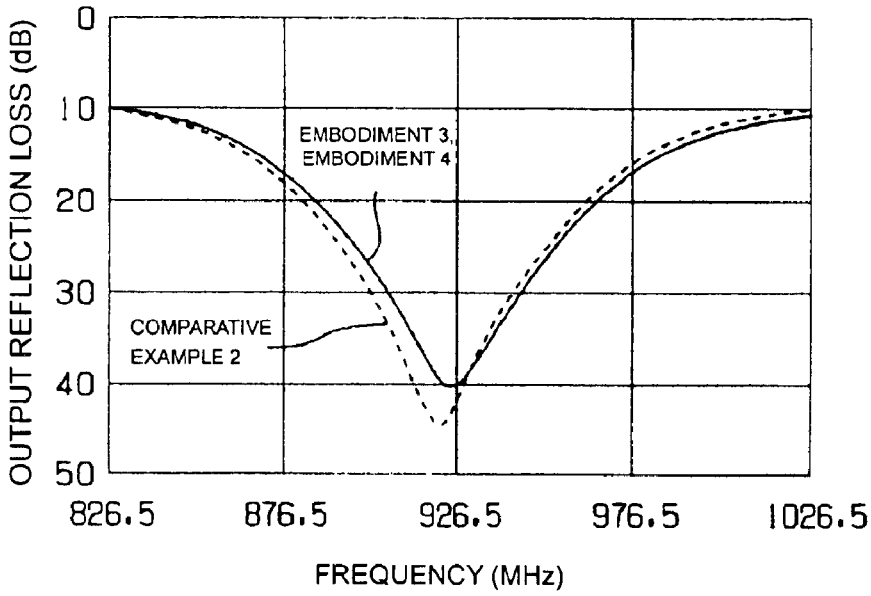
FIG. 21 is a graph showing output reflection loss characteristics.

FIG. 17 is an electric equivalent circuit diagram of a two-port isolator 1B. An LC parallel resonance circuit including the first central electrode 21 and the first matching capacitor 25 is connected between the input port P1 and the output port P2. An LC parallel resonance circuit including the second central electrode 22 and the second matching capacitor 26 is connected between the output port P2 and the third port P3. Moreover, a terminating resistor 27 is connected between the third port P3 and the external grounding electrode 16.

FIGS. 18 to 21 are graphs showing isolation characteristics, insertion loss characteristics, input reflection loss characteristics, and output reflection loss characteristics, respectively, when the real inductances L1 and L2 of the first and second central electrodes 21 and 22 and the capacitances C1 and C2 of the matching capacitors 25 and 26 in a two-port isolator 1B are changed as shown in Table 3-1. The resistance value R of the resistor 27 is about 60 Ω in all cases. The inductance in Table 3-1 shows the real self-inductance of the central electrodes 21 and 22 when the relative magnetic permeability is assumed to be about 1, and the inductances L1 and L2 were obtained when the inductances were multiplied by the effective permeability of the ferrite 20. Furthermore, the worst values in the band of 893 MHz to 960 MHz are summarized in Table 3-2.

TABLE 3-1

| | Self-inductance of first central electrode 21 | Self-inductance of second central electrode 22 | Capacitance C1 of matching capacitor 25 | Capacitance C2 of matching capacitor 26 |
|---|---|---|---|---|
| Comparative example 2 | 0.7 nH | 0.7 nH | 22 pF | 22 pF |
| Preferred Embodiment 3 | 0.5 nH | 1.0 nH | 32 pF | 15 pF |
| Preferred Embodiment 4 | 1.0 nH | 0.5 nH | 15 pF | 32 pF |

TABLE 3-2

| | Input reflection loss (dB) | Insertion loss (dB) | Isolation (dB) | Output reflection loss (dB) |
|---|---|---|---|---|
| Comparative example 2 | 12.0 | 1.11 | 9.9 | 22.2 |
| Preferred Embodiment 3 | 14.3 | 0.75 | 8.0 | 22.5 |
| Preferred Embodiment 4 | 9.3 | 1.60 | 12.0 | 22.6 |

From FIGS. 18 to 21 and Table 3-2, when the self-inductance of the first central electrode 21 is less than the self-inductance of the second central electrode 22, as in the third preferred embodiment, although the isolation is deteriorated, the insertion loss and reflection loss are greatly improved.

On the contrary, as in fourth preferred embodiment, when the self-inductance of the first central electrode 21 is greater than the self-inductance of the second central electrode 22, although the insertion loss and reflection loss are deteriorated, the isolation is greatly improved.

In this manner, when the self-inductances of the two central electrodes 21 and 22 are made different from each other, the insertion loss and isolation can be optimized to provide an isolator 1B having excellent characteristics.

Furthermore, normally the insertion loss required in a two-port isolator used in mobile communication equipment is about 1.2 dB or less and the isolation is at least about 8.0 dB. Two-port isolators 1B meeting these conditions were investigated by changing the capacitance ratio C1/C2 of the matching capacitors 25 and 26. Table 4 shows the results, and FIGS. 22 to 24 are graphs showing the isolation characteristic, insertion loss characteristic, and input reflection characteristic, respectively.

TABLE 4

| C1/C2 | Input reflection loss (dB) | Insertion loss (dB) | Isolation (dB) | Output reflection loss (dB) |
|---|---|---|---|---|
| 0.33 | 7.70 | 2.20 | 13.50 | 23.00 |
| 0.50 | 9.30 | 1.60 | 12.00 | 22.60 |
| 0.66 | 11.30 | 1.42 | 10.80 | 21.80 |
| 0.90 | 11.60 | 1.18 | 10.20 | 21.90 |
| 1.00 | 12.00 | 1.11 | 9.90 | 22.20 |
| 1.10 | 12.30 | 1.06 | 9.60 | 21.80 |
| 1.50 | 13.30 | 0.92 | 8.70 | 21.90 |
| 2.00 | 14.30 | 0.75 | 8.00 | 22.50 |
| 3.00 | 17.10 | 0.56 | 6.60 | 23.00 |
| 3.50 | 18.00 | 0.48 | 6.30 | 24.10 |

Figure 22:
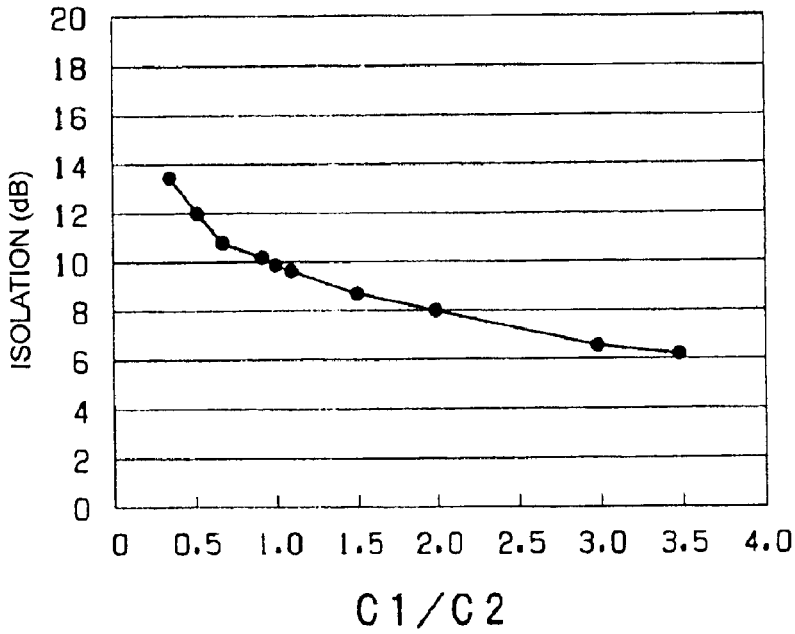
FIG. 22 is a graph showing the relationship between the ratio C1/C2 and isolation.
Figure 23:
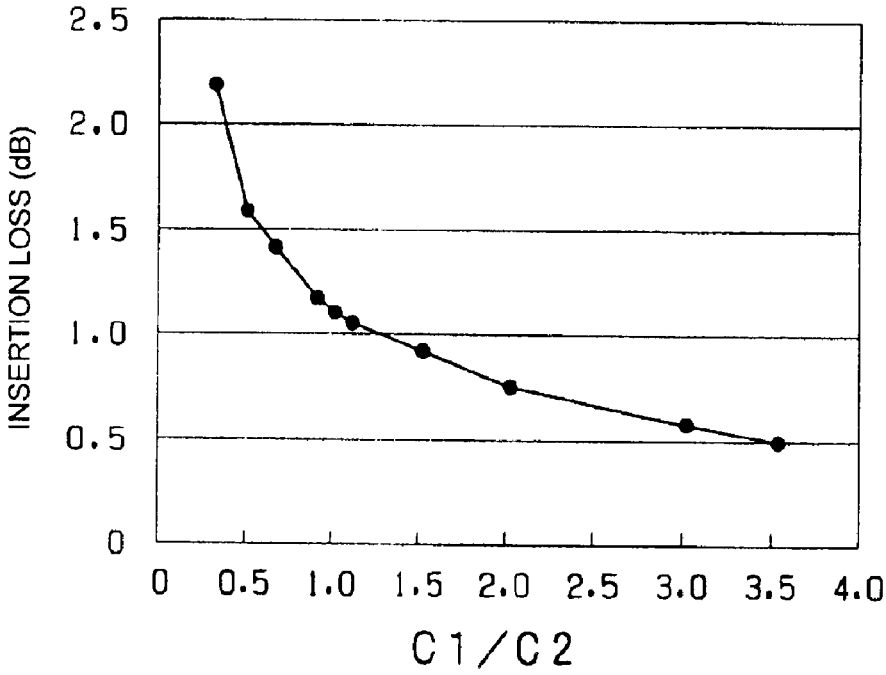
FIG. 23 is a graph showing the relationship between the ratio C1/C2 and insertion loss.
Figure 24:
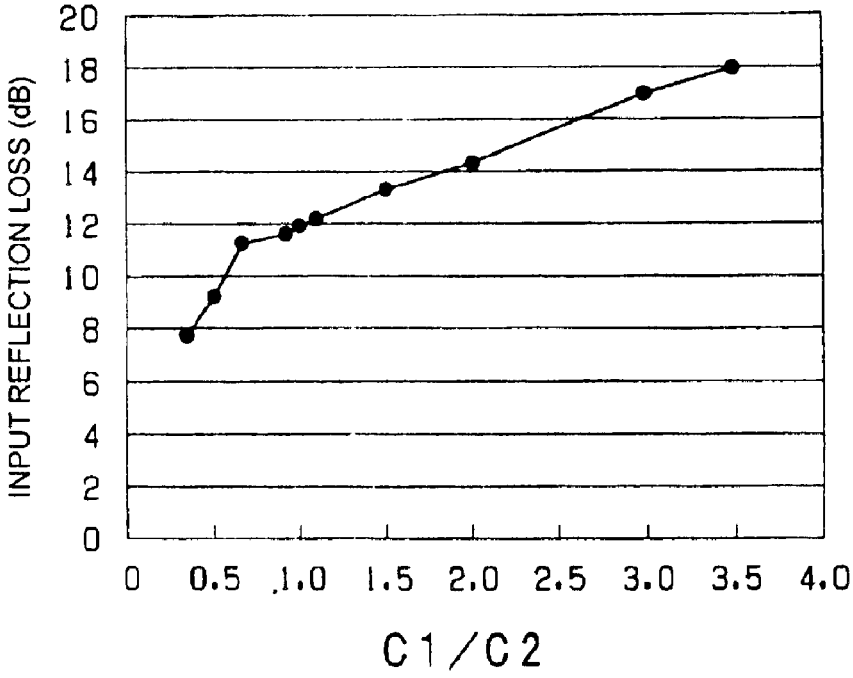
FIG. 24 is a graph showing the relationship between the ratio C1/C2 and input reflection loss.

From Table 4 and FIGS. 22 and 23, when the value of C1/C2 was designed to satisfy the expression $1.1 \leqq C1/C2 \leqq 2.0$, a two-port isolator 1B having about 1.2 dB or less insertion loss and at least about 8.0 dB isolation is obtained.

Fourth Preferred Embodiment

In a fourth preferred embodiment, a communication device of the present invention is described with reference to a portable telephone, as an example.

Figure 25:
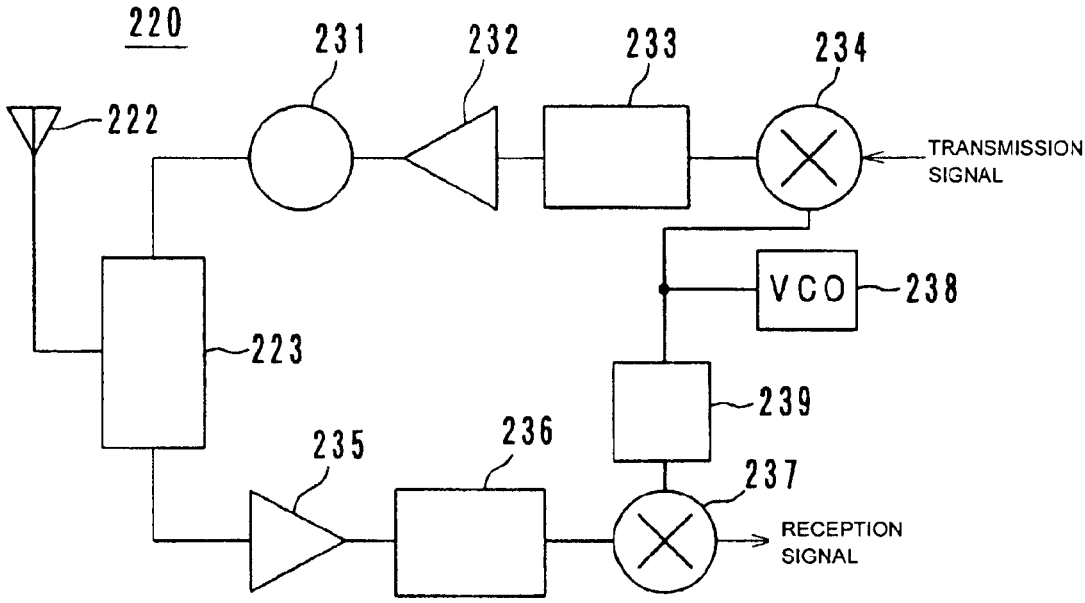
FIG. 25 is an electrical circuit block diagram of a communication device of a preferred embodiment of the present invention.

FIG. 25 is a block diagram of an RF portion of a portable telephone 220. In FIG. 25, an antenna element 222, a duplexer 223, a transmission-side isolator 231, a transmission-side amplifier 232, a transmission-side interstage bandpass filter 233, a transmission-side mixer 234, a reception-side amplifier 235, a reception-side interstage bandpass filter 236, a reception-side mixer 237, a voltage-controlled oscillator (VCO) 238, and a local bandpass filter 239 are shown.

Here, two-port isolators 1, 1A, and 1B according to the first to third preferred embodiments may be used as the transmission-side isolator 231. When these isolators are mounted, a portable telephone having greatly improved electrical characteristics and outstanding reliability is achieved.

Moreover, the present invention is not limited to the above-described preferred embodiments, but may be altered within the true spirit and scope of the present invention. For example, when the N and S poles of the permanent magnet are reversed, the input port P1 and output port P2 change places with each other.

Figure 26:
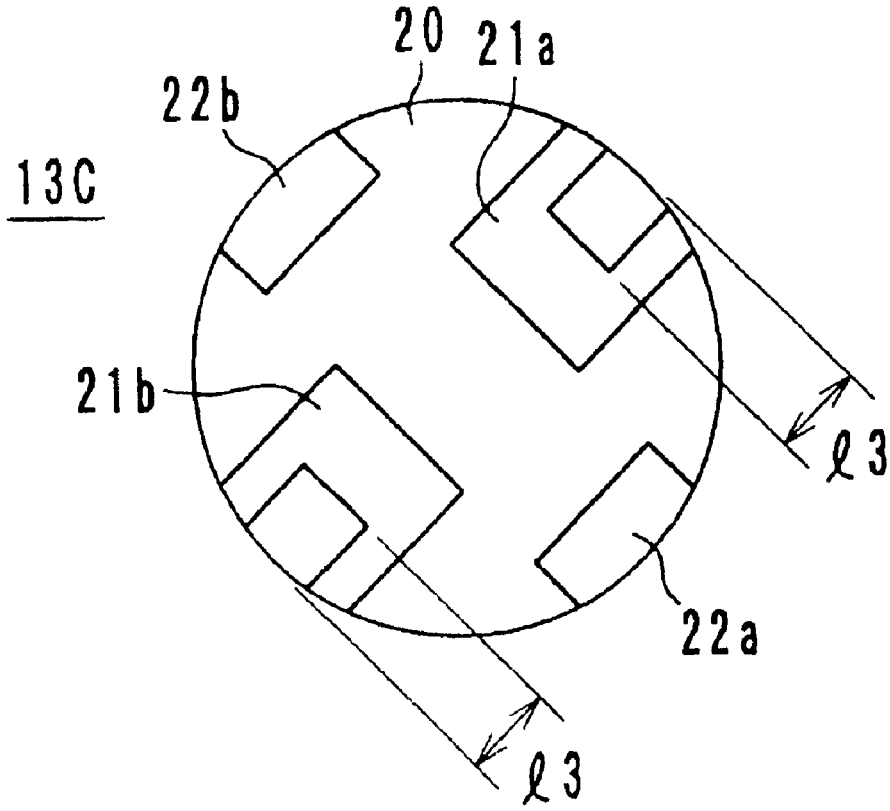
FIG. 26 is a bottom view showing a modified example of the central electrode assembly according to preferred embodiments of the present invention.
Figure 27:
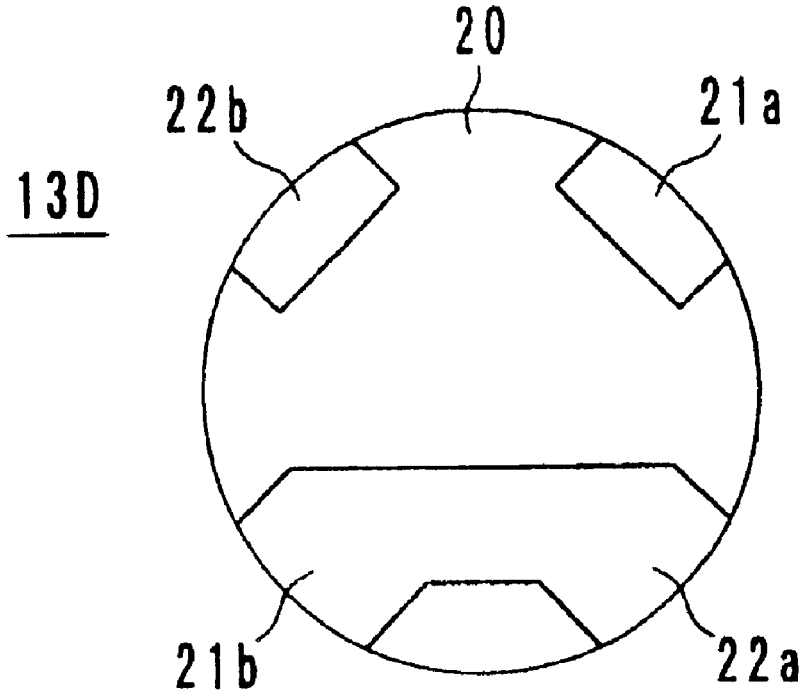
FIG. 27 is a bottom view showing another modified example of the central electrode assembly according to preferred embodiments of the present invention.

Furthermore, the central electrode assembly can also be modified. For example, as in a central electrode assembly 13C shown in FIG. 26, the length of the central electrode 21 provided on the bottom surface of the ferrite 20 is extended by 13 and the lengths of the central electrodes 21 and 22 are different from each other. In this case, the locations of the connection electrodes 51 and 54 for the central electrodes in the laminated substrate 30 are moved inside. Furthermore, as in a central electrode assembly 13D shown in FIG. 27, the end portions 21*b* and 22*a* of the central electrodes 21 and 22 provided on the bottom surface of the ferrite 20 may be electrically connected. In this case, either of the connection electrodes 53 and 54 for the central electrodes of the laminated substrate 30 can be omitted and the number of via holes can thus be reduced.

Figure 28:
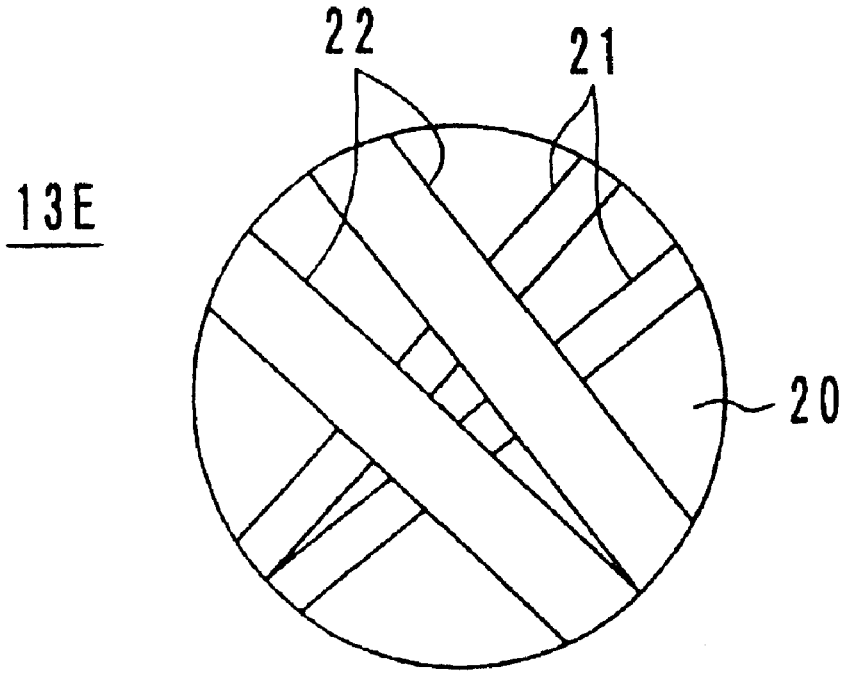
FIG. 28 is a top view showing another modified example of the central electrode assembly according to preferred embodiments of the present invention.
Figure 29:
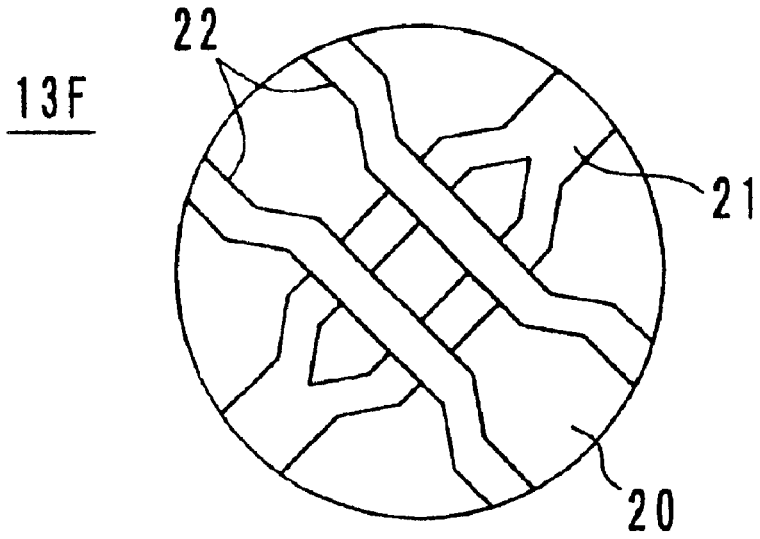
FIG. 29 is a top view showing another modified example of the central electrode assembly according to preferred embodiments of the present invention.
Figure 30:
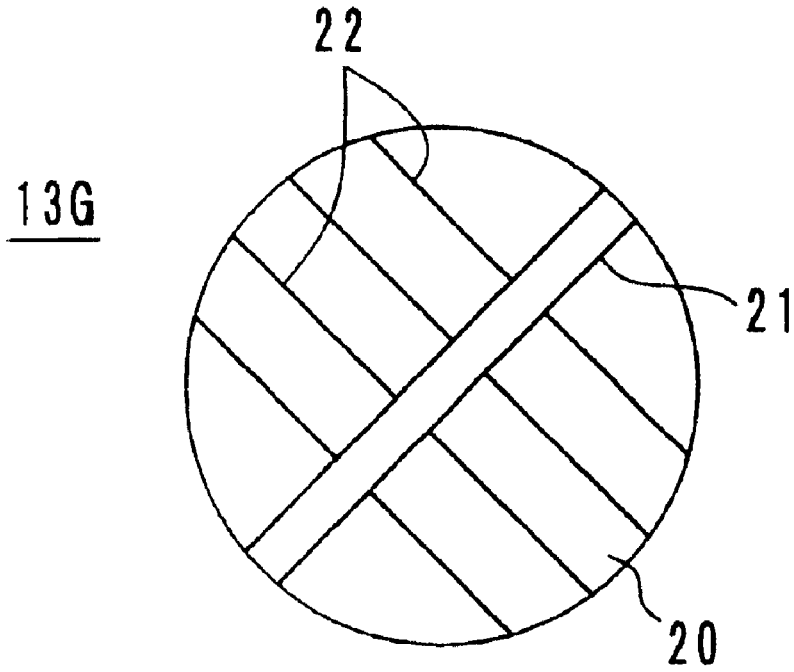
FIG. 30 is a top view showing another modified example of the central electrode assembly according to preferred embodiments of the present invention.
Figure 31:
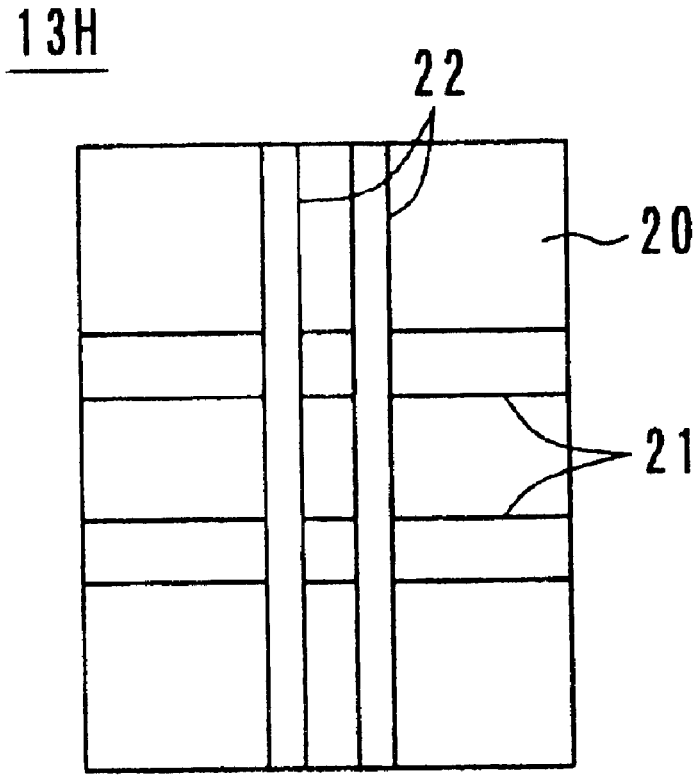
FIG. 31 is a top view showing another modified example of the central electrode assembly according to preferred embodiments of the present invention.

As in central electrode assemblies 13E, 13F, and 13G shown in FIGS. 28 to 30, the central electrodes 21 and 22 need not be parallel to each other, but may be bent, or may have different numbers of electrodes. Moreover, as in a central electrode assembly 13H shown in FIG. 31, a substantially rectangular ferrite 20 may be used. In that case, the first central electrode 21 is disposed so as to be substantially parallel to the short side and the second central electrode 22 is disposed so as to be substantially parallel to the long side of the ferrite 20.

As is clearly understood in the above description, according to the present invention, the insertion loss and isolation is optimized and a two-port isolator having outstanding characteristics is provided by making the inductances of the first central electrode and second central electrode different from each other. As a result, a high-performance, high-reliability, and small two-port isolator and communication device is obtained.

It should be understood that the foregoing description is only illustrative of the present invention. Various alternatives and modifications can be devised by those skilled in the art without departing from the present invention. Accordingly, the present invention is intended to embrace all such alternatives, modifications and variances which fall within the scope of the appended claims.

What is claimed is:

1. A two-port isolator comprising:

a permanent magnet;

a ferrite to which a DC magnetic field is applied by the permanent magnet;

a first central electrode disposed on a main surface of the ferrite or inside the ferrite, one end of the first central electrode being electrically connected to a first input-output port, and the other end of the first central electrode being electrically connected to a second input-output port;

a second central electrode disposed on the main surface of the ferrite or inside the ferrite so as to intersect the first central electrode with electrical insulation disposed therebetween, one end of the second central electrode being electrically connected to the second input-output port, and the other end of the second central electrode being electrically connected to a third port;

a first matching capacitor electrically connected between the first input-output port and the second input-output port;

a resistor electrically connected between the first input-output port and the second input-output port; and a second matching capacitor electrically connected between the second input-output port and the third port;

wherein the third port is electrically connected to a ground and the inductance L1 of the first central electrode is different from the inductance L2 of the second central electrode.

2. A two-port isolator as claimed in claim 1, wherein the first central electrode has a different shape from that of the second central electrode.

3. A two-port isolator as claimed in claim 1, wherein the electrode width W1 of the first central electrode is different from the electrode width W2 of the second central electrode.

4. A two-port isolator as claimed in claim 1, wherein the electrode thickness t1 of the first central electrode is different from the electrode thickness t2 of the second central electrode.

5. A two-port isolator as claimed in claim 1, wherein the electrode length l1 of the first central electrode is different from the electrode length l2 of the second central electrode.

6. A two-port isolator as claimed in claim 1, wherein the number of electrodes in the first central electrode is different from the number of electrodes in the second central electrode.

7. A two-port isolator as claimed in claim 1, wherein each of the first central electrode and the second central electrode includes a plurality of electrodes and the spacing S1 between electrodes in the first central electrode is different from the spacing S2 between electrodes in the second central electrode.

8. A two-port isolator as claimed in claim 1, wherein the capacitance C1 of the first matching capacitor and the capacitance C2 of the second matching capacitor satisfy the expression $0.5 \leqq C1/C2 \leqq 0.9$.

9. A two-port isolator as claimed in claim 1, wherein the capacitance C1 of the first matching capacitor and the capacitance C2 of the second matching capacitor satisfy the expression $1.1 \leqq C1/C2 \leqq 3.0$.

10. A two-port isolator as claimed in claim 1, further comprising a metal case which encloses the permanent magnet, the ferrite, and the first and second central electrodes, wherein the metal case includes a top surface portion, a bottom surface portion, and a pair of opposing side surface portions which join the top surface portion and the bottom surface portion;

one of the first central electrode and the second central electrode is disposed so as to be substantially perpendicular to the side surface portions; and the other of the first central electrode and the second central electrode is disposed so as to be substantially parallel to the side surface portions.

11. A two-port isolator as claimed in claim 1, wherein the first external input-output electrode electrically connected to the first input-output port and the second external input-output electrode electrically connected to the second input-output port are provided in the middle of a pair of opposing side surfaces of the two-port isolator, respectively.

12. A two-port isolator as claimed in claim 1, wherein the ferrite is substantially rectangular when viewed from above, and the first central electrode is disposed so as to be substantially parallel to one side of the substantially rectangular ferrite and the second central electrode is disposed so as to be substantially parallel to a side at a right angle to the one side.

13. A communication device comprising a two-port isolator as claimed in claim 1.

14. A two-port isolator comprising:

a permanent magnet;

a ferrite to which a DC magnetic field is applied by the permanent magnet;

a first central electrode disposed on a main surface of the ferrite or inside the ferrite, one end of the first central electrode being electrically connected to a first input-output port, and the other end of the first central electrode being electrically connected to a second input-output port;

a second central electrode disposed on the main surface of the ferrite or inside the ferrite so as to intersect the first central electrode with electrical insulation disposed therebetween, one end of the second central electrode being electrically connected to the second input-output port, and the other end of the second central electrode being electrically connected to a third port;

a first matching capacitor electrically connected between the first input-output port and the second input-output port;

a second matching capacitor electrically connected between the second input-output port and the third port, a resistor electrically connected between the third port and a ground; wherein the inductance L1 of the first central electrode is different from the inductance L2 of the second central electrode.

15. A two-port isolator as claimed in claim 14, wherein the first central electrode has a different shape than the second central electrode.

16. A two-port isolator as claimed in claim 14, wherein the electrode width W1 of the first central electrode is different from the electrode width W2 of the second central electrode.

17. A two-port isolator as claimed in claim 14, wherein the electrode thickness t1 of the first central electrode is different from the electrode thickness t2 of the second central electrode.

18. A two-port isolator as claimed in claim 14, wherein the electrode length l1 of the first central electrode is different from the electrode length l2 of the second central electrode.

19. A two-port isolator as claimed in claim 14, wherein the number of electrodes in the first central electrode is different from the number of electrodes in the second central electrode.

20. A two-port isolator as claimed in claim 14, wherein each of the first central electrode and the second central electrode includes a plurality of electrodes and the spacing S1 between electrodes in the first central electrode is different from the spacing S2 between electrodes in the second central electrode.

21. A two-port isolator as claimed in claim 14, wherein the capacitance C1 of the first matching capacitor and the capacitance C2 of the second matching capacitor satisfy the expression $0.5 \leqq C1/C2 \leqq 0.9$.

22. A two-port isolator as claimed in claim 14, wherein the capacitance C1 of the first matching capacitor and the capacitance C2 of the second matching capacitor satisfy the expression $1.1 \leqq C1/C2 \leqq 3.0$.

23. A two-port isolator as claimed in claim 14, wherein the capacitance C1 of the first matching capacitor and the capacitance C2 of the second matching capacitor satisfy the expression $1 \leqq C1/C2 \leqq 2.0$.

24. A two-port isolator as claimed in claim 14, further comprising a metal case which encloses the permanent magnet, the ferrite, and the first and second central electrodes, wherein the metal case includes a top surface portion, a bottom surface portion, and a pair of opposing side surface portions which join the top surface portion and the bottom surface portion;

one of the first central electrode and the second central electrode is arranged so as to be substantially perpendicular to the side surface portions; and the other of the first central electrode and the second central electrode is arranged so as to be substantially parallel to the side surface portions.

25. A two-port isolator as claimed in claim 14, wherein the first external input-output electrode electrically connected to the first input-output port and the second external input-output electrode electrically connected to the second input-output port are provided in the middle of a pair of opposing side surfaces of the two-port isolator, respectively.

26. A two-port isolator as claimed in claim 14, wherein the ferrite is substantially rectangular when viewed from above, and wherein the first central electrode is disposed so as to be substantially parallel to one side of the substantially rectangular ferrite and the second central electrode is disposed so as to be substantially parallel to a side at a right angle to the one side.

27. A communication device comprising a two-port isolator as claimed in claim 14.

* * * * *